US008500115B2

(12) United States Patent
Yamomoto et al.

(10) Patent No.: US 8,500,115 B2
(45) Date of Patent: Aug. 6, 2013

(54) FEED ASSEMBLY AND IMAGE FORMING APPARATUS INCORPORATING FEED ASSEMBLY

(75) Inventors: Kiyonori Yamomoto, Osaka (JP); Takeshi Marumoto, Osaka (JP)

(73) Assignee: Kyocera Mita Corporation (JP)

( * ) Notice: Subject to any disclaimer, the term of this patent is extended or adjusted under 35 U.S.C. 154(b) by 2 days.

(21) Appl. No.: 12/952,243

(22) Filed: Nov. 23, 2010

(65) Prior Publication Data

US 2011/0127710 A1 Jun. 2, 2011

(30) Foreign Application Priority Data

Nov. 27, 2009 (JP) ..... 2009-269716
Mar. 4, 2010 (JP) ..... 2010-048018

(51) Int. Cl.
*B65H 3/52* (2006.01)

(52) U.S. Cl.
USPC ..... 271/121

(58) Field of Classification Search
USPC ..... 271/109, 121–124, 145; 399/361, 399/381, 388, 391–393
See application file for complete search history.

(56) References Cited

U.S. PATENT DOCUMENTS

| | | | | |
|---|---|---|---|---|
| 4,865,306 | A | 9/1989 | Himegi | |
| 7,275,741 | B2 * | 10/2007 | Worley et al. | 271/117 |
| 2002/0158403 | A1 * | 10/2002 | Hsiao et al. | 271/121 |
| 2004/0041334 | A1 * | 3/2004 | Yoshihara | 271/145 |
| 2007/0145666 | A1 * | 6/2007 | Nishikata et al. | 271/18 |
| 2008/0217839 | A1 * | 9/2008 | Bingham et al. | 271/121 |

FOREIGN PATENT DOCUMENTS

| | | | |
|---|---|---|---|
| JP | 63-208451 | * | 8/1988 |
| JP | 2-110040 | | 4/1990 |
| JP | 2-66535 | | 5/1990 |
| JP | 4-55236 | * | 2/1992 |
| JP | 08-133511 | | 5/1996 |
| JP | 8-157086 | | 6/1996 |
| JP | 8-245007 | * | 9/1996 |
| JP | 2002-104675 | | 4/2002 |
| JP | 2004-59170 | | 2/2004 |
| JP | 2004-224485 | * | 8/2004 |
| JP | 2004-269069 | | 9/2004 |
| JP | 2004-331380 | | 11/2004 |
| JP | 2005-133042 | * | 5/2005 |

OTHER PUBLICATIONS

Machine translation of Detailed description of JP2004-224485.*

* cited by examiner

*Primary Examiner* — Gerald McClain
*Assistant Examiner* — Thomas Morrison
(74) *Attorney, Agent, or Firm* — Gerald E. Hespos; Michael J. Porco; Matthew T. Hespos

(57) ABSTRACT

A feed assembly configured to feed a sheet, including: a feed roller configured to convey the sheet; a support element configured to rotatably and detachably support the feed roller; a base including a guide surface configured to guide the sheet; a frictional element configured to generate a frictional force on the sheet guided by the guide surface; and an elastic member provided between the frictional element and the base; wherein a recess is defined in the guide surface to accommodate the frictional element; and the elastic member causes the frictional element to project from the guide surface when the feed roller is detached from the support element.

8 Claims, 24 Drawing Sheets

FEED ASSEMBLY AND IMAGE FORMING APPARATUS INCORPORATING FEED ASSEMBLY

BACKGROUND OF THE INVENTION

1. Field of the Invention

The present invention relates to a feed assembly and an image forming apparatus incorporating the feed assembly.

2. Description of the Related Art

Image forming apparatuses such as copiers, printers, fax machines or composite machines which are equipped with their functions, typically include a feed assembly configured to pick out a sheet one by one from a pile of stacked sheets and convey the sheet to an image forming unit. The feed assembly typically includes a feed roller abutting against an upper surface of the sheet pile and a pad facing the rotating feed roller. If the feed roller picks out several sheets from the sheet pile, then the pad applies a frictional force to the sheets except for the uppermost sheet to prevent excessive sheets from moving downstream.

The conveyance of sheets employs the frictional force between the sheet and the feed roller/pad. Consequently, wearing of the feed roller and/or the pad is inevitable. A worn feed roller and/or a worn pad cause defective feed of sheets. Accordingly, in case of the defective feed of the sheets, a well experienced operator replaces a feed roller and/or a pad.

A particular image forming apparatus comprises a feed assembly configured to entirely rotate outwardly. The rotating structure of the feed assembly provides a wider working space to replace a feed roller and/or a pad. It is not, however, usually easy for people (for example, users of the image forming apparatus) except experienced operators to replace these consumable parts because they have to rotate the feed assembly and replace the feed roller and/or the pad.

It has also been attempted to lengthen a lifespan of the consumable parts. The need for replacing consumable parts is, however, still remains although such attempts may decrease frequency of replacing the consumable parts. Consequently, there is still a need for an experienced operator to replace the consumable parts.

Another particular image forming apparatus allows replacement just for a worn portion of a feed roller. Such image forming apparatus, however, does not address easier replacement of a pad. Moreover, the structure allowing replacement just for the worn portion of the feed roller results in a more complicated structure of the feed roller, which, in turn, leads to a more expensive feed roller.

The problem described above is also common to other frictional elements configured to cause a frictional force against sheet conveyance (for example, a retarding roller). Consequently, in the present circumstances, there is a need for a technology allowing a person except experienced operator to easily replace frictional elements such as a pad or a retarding roller.

SUMMARY OF THE INVENTION

It is an object of the present invention to provide a feed assembly allowing easier replacement of a frictional element even by a person other than an experienced operator, and an image forming apparatus incorporating the feed assembly.

The feed assembly configured to feed a sheet according to one aspect of the present invention includes: a feed roller configured to convey the sheet; a support element configured to rotatably and detachably support the feed roller; a base including a guide surface configured to guide the sheet; a frictional element configured to generate a frictional force on the sheet guided by the guide surface; and an elastic member provided between the frictional element and the base; wherein a recess is defined in the guide surface to accommodate the frictional element; and the elastic member causes the frictional element to project from the guide surface when the feed roller is detached from the support element.

The image forming apparatus configured to form an image of a sheet according to another aspect of the present invention includes: a feed assembly configured to feed the sheet; and an image forming unit configured to form the image on the sheet conveyed from the feed assembly; wherein the feed assembly comprises: a feed roller configured to convey a sheet; a support element configured to detachably and rotatably support the feed roller; a base including a guide surface configured to guide the sheet; a frictional element configured to generate a frictional force on the sheet guided by the guide surface; and an elastic member provided between the frictional element and the base; and a recess is defined in the guide surface to accommodate the friction element; and the elastic member causes the frictional element to project from the guide surface when the feed roller is detached from the support element.

DETAILED DESCRIPTION OF THE PREFERRED EMBODIMENTS

A first embodiment is described below with reference to the accompanying drawings. Terms indicating the directions, "upper", "lower", "left" and "right" and the like, which are used herein, are just for clarifying the following description and should not be interpreted in any limiting manners. Furthermore, in the description below, a term "sheet" means copying paper, coated paper, an OHP sheet, cardboard, postcard, tracing paper or any other sheet material to be subjected to an image forming process. A term "leading edge of the sheet" means an edge of the sheet on a preceding side in a conveyance direction of the sheet. A term "width direction of the sheet" means a direction perpendicular to the sheet conveyance direction. Terms "upstream", "downstream" and similar terms which are used in the following description mean "upstream", "downstream" and similar concepts in respect of the sheet conveyance direction.

First Embodiment

Figure 1:
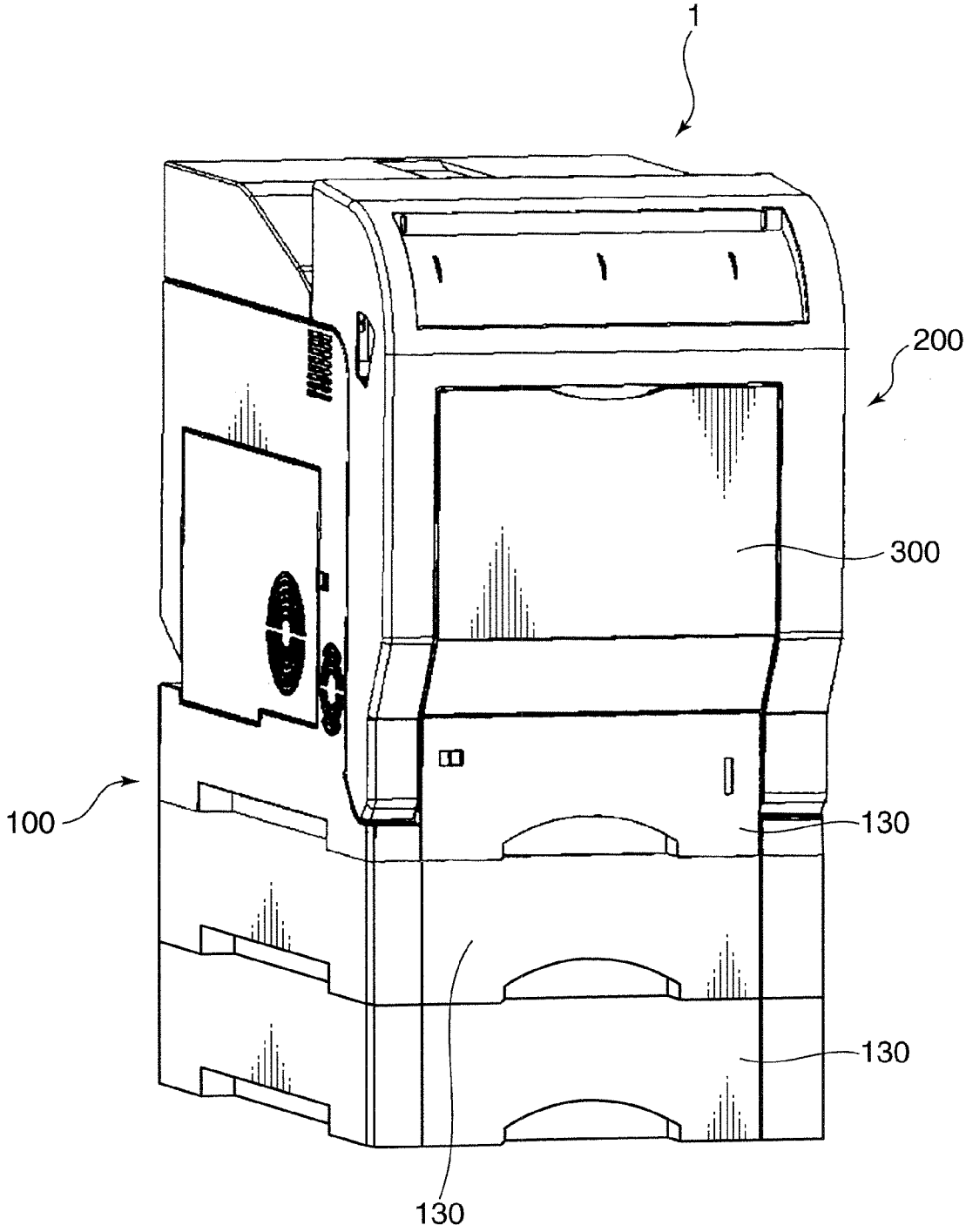
FIG. 1 is a schematic perspective view of an image forming apparatus according to a first embodiment.

FIG. 1 is a perspective view of an image forming apparatus according to a first embodiment. The image forming apparatus shown in FIG. 1 is a color printer. Alternatively, the image forming apparatus may also be a copier, a monochrome printer, a facsimile machine, a composite machine with their functions or another apparatus configured to form an image on a sheet.

The color printer 1 comprises a main unit 200 connected, either directly or via a LAN, to an external apparatus such as a personal computer (PC), and a sheet feeding section 100 below the main unit 200. A user may, for example, accommodate different sheets in size into the sheet feeding section 100. Furthermore, the color printer 1 also includes a control circuit (not illustrated) configured to control operation of the color printer 1 and other elements which typical color printers include.

Figure 2:
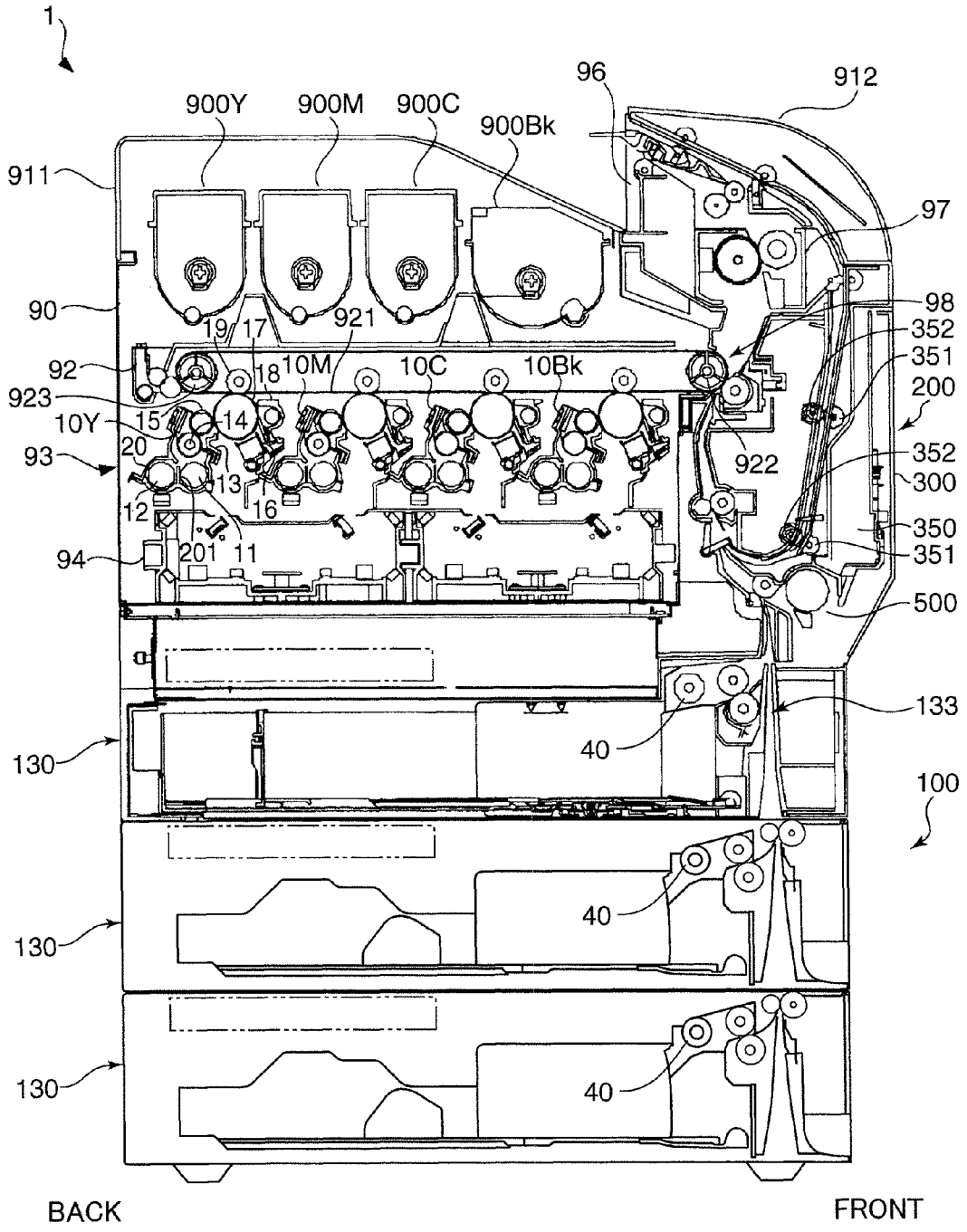
FIG. 2 is a schematic view of an internal configuration of the image forming apparatus shown in FIG. 1.

FIG. 2 is a cross-sectional view showing an internal configuration of the color printer 1. The internal configuration of the color printer 1 is now described with reference to FIGS. 1 and 2.

The main unit 200 above the sheet feeding section 100 comprises an intermediate transfer unit 92, an image forming unit 93, an exposure unit 94, a fixing unit 97, a discharge unit 96, a housing 90, a top cover 911 and a front cover 912.

The image forming unit 93 comprises a toner container 900Y configured to accommodate yellow toner, a toner container 900M configured to accommodate magenta toner, a toner container 900C configured to accommodate cyan toner, and a toner container 900Bk configured to accommodate black toner. The image forming unit 93 also comprises developing apparatuses 10Y, 10M, 10C and 10Bk which are disposed below the toner containers 900Y, 900M, 900C and 900Bk, respectively.

The image forming unit 93 also comprises a few photosensitive drums 17 (photosensitive elements on which latent images are formed by an electrophotographic method) which carry toner images. A photosensitive drum with an amorphous silicon (a-Si) material is exemplified as the photosensitive drum 17. The yellow toner, the magenta toner, cyan toner and black toner are supplied to the photosensitive drums 17 from the toner containers 900Y, 900M, 900C and 900Bk, respectively.

The image forming unit 93 also comprises a charging device 16, a transfer roller 19 and a cleaning apparatus 18, which are disposed around the photosensitive drum 17. The charging device 16 uniformly charges a circumferential surface of the photosensitive drum 17. The exposure unit 94 exposes the charged surface of the photosensitive drum 17 to form an electrostatic latent image. The developing apparatuses 10Y, 10M, 10C and 10Bk develop (create visible images of) the electrostatic latent images formed on the photosensitive drums 17 using the toner supplied from the toner containers 900Y, 900M, 900C and 900Bk, respectively. The transfer roller 19 and the photosensitive drum 17 nip an intermediate transfer belt 921, which is described hereinafter, to form a nip section in which the toner image on the photosensitive drum 17 is primarily transferred onto the intermediate transfer belt 921. The cleaning apparatus 18 cleans the circumferential surface of the photosensitive drum 17 after the transfer of the toner image.

Each of the developing apparatuses 10Y, 10M, 10C and 10Bk comprises a housing 20 and two agitating rollers 11, 12 inside the housing 20. Two-component developer including magnetic carrier and toner is accommodated inside the housing 20. The agitating rollers 11 and 12 rotating near a bottom of the housing 20 extend mutually in parallel.

The internal bottom surface of the housing 20 defines a circulation path of the developer. The agitating rollers 11 and 12 are disposed inside the circulation path. The housing 20 comprises a partition 201 standing from the bottom of the housing 20 between the agitating rollers 11 and 12. The partition 201 extending along the agitating rollers 11 and 12 defines the partially divided circulation path. The circulation path loops around the partition wall 201.

The toner is charged while the two-component developer is circulated inside the housing 20 and agitated by the agitating rollers 11 and 12. The developing apparatuses 10Y, 10M, 10C and 10Bk comprise a magnetic roller 14 above the agitating roller 11, respectively. The two-component developer on the agitating roller 11 is attracted to and conveyed by the magnetic roller 14. The attracted two-component developer forms a magnetic brush (not illustrated) on the magnetic roller 14.

The developing apparatuses 10Y, 10M, 10C and 10Bk comprise a doctor blade 13 configured to restrict thickness of the magnetic brush, respectively. A toner layer on the developing roller 15 is formed by a potential difference between the magnetic roller 14 and the developing roller 15. The electrostatic latent image on the photosensitive drum 17 is developed with the toner layer.

The exposure unit 94 including various optical elements such as a light source, a polygon mirror, a reflective mirror and a deflective mirror irradiates light onto the circumferential surface of each photosensitive drum 17 of the image forming unit 93 based on image data to form an electrostatic latent image.

The intermediate transfer unit 92 comprises, in addition to the intermediate transfer belt 921 described above, a drive roller 922 and an idle roller 923. Toner images are superimposed onto the intermediate transfer belt 921 from the photosensitive drums 17 (primary transfer). In a secondary transfer unit 98, the superimposed toner images are then secondarily transferred to a sheet fed from a feed unit 130 (described hereinafter). The driver roller 922 and the idle roller 923 revolve the intermediate transfer belt 921. The drive roller 922 and the idle roller 923 are rotatably held by the housing 90.

The fixing unit 97 carries out a fixing process for the toner image on the sheet after the secondary transfer from the intermediate transfer unit 92. The sheet bearing a color image after the fixing process is discharged toward the discharge unit 96 in an upper portion of the main unit 200.

The discharge unit 96 discharges a sheet conveyed from the fixing unit 97 onto the top cover 911 which is used as a discharge tray.

The sheet feeding section 100 comprises three feed units 130 which are detachably mounted in the main unit 200. Alternatively, the sheet feeding section 100 may also comprise one or two feed units 130. A further alternative is that the sheet feeding section 100 may comprise more than three feed units 130.

The feed unit 130 accommodates a pile of sheets including stacked sheets on which an image is to be formed. The feed unit 130 is detachably mounted in the housing 90 of the color printer 1. A user may store sheet piles in the feed units 130, respectively. The user may operate the color printer 1 to select one of the feed units 130.

The feed unit 130 comprises a pick-up roller 40. The pick-up roller 40 in the feed unit 130 selected by operating the color printer 1 is driven, so that the sheet on the uppermost layer of the sheet pile is picked out one after another. The sheet picked out by the pick-up roller 40 is conveyed to a feed conveyance path 133 and is then introduced into the image forming unit 93.

The feed units 130 comprise a conveyance mechanism, respectively. The conveyance mechanisms of the feed units 130 mutually stacked below the main unit 200 are joined together to form the single feed conveyance path 133 extending to the main unit 200.

The color printer 1 also comprises a feed tray 300 which is disposed above the feed units 130. The feed tray 300 is rotatably mounted on a front surface of the housing 90 of the color printer 1 (a side where the feed units 130 are pulled out). The feed tray 300 shown in FIGS. 1 and 2 is in a closed position where a sheet inlet for introducing a sheet into the housing 90 is closed. A rotational axis is defined on a lower end of the feed tray 300. A user may load a sheet pile containing stacked sheets on the feed tray 300 after pulling and rotating the feed tray 300 forwards about the rotational axis.

The color printer 1 also comprises a feed assembly 500 which is disposed near the lower end of the feed tray 300 supporting the sheet pile. The feed assembly 500 picks out a sheet, one after another from the sheets loaded on the feed tray 300 to the image forming unit 93. As described above, the image forming unit 93 forms an image on the sheet.

Figure 3:
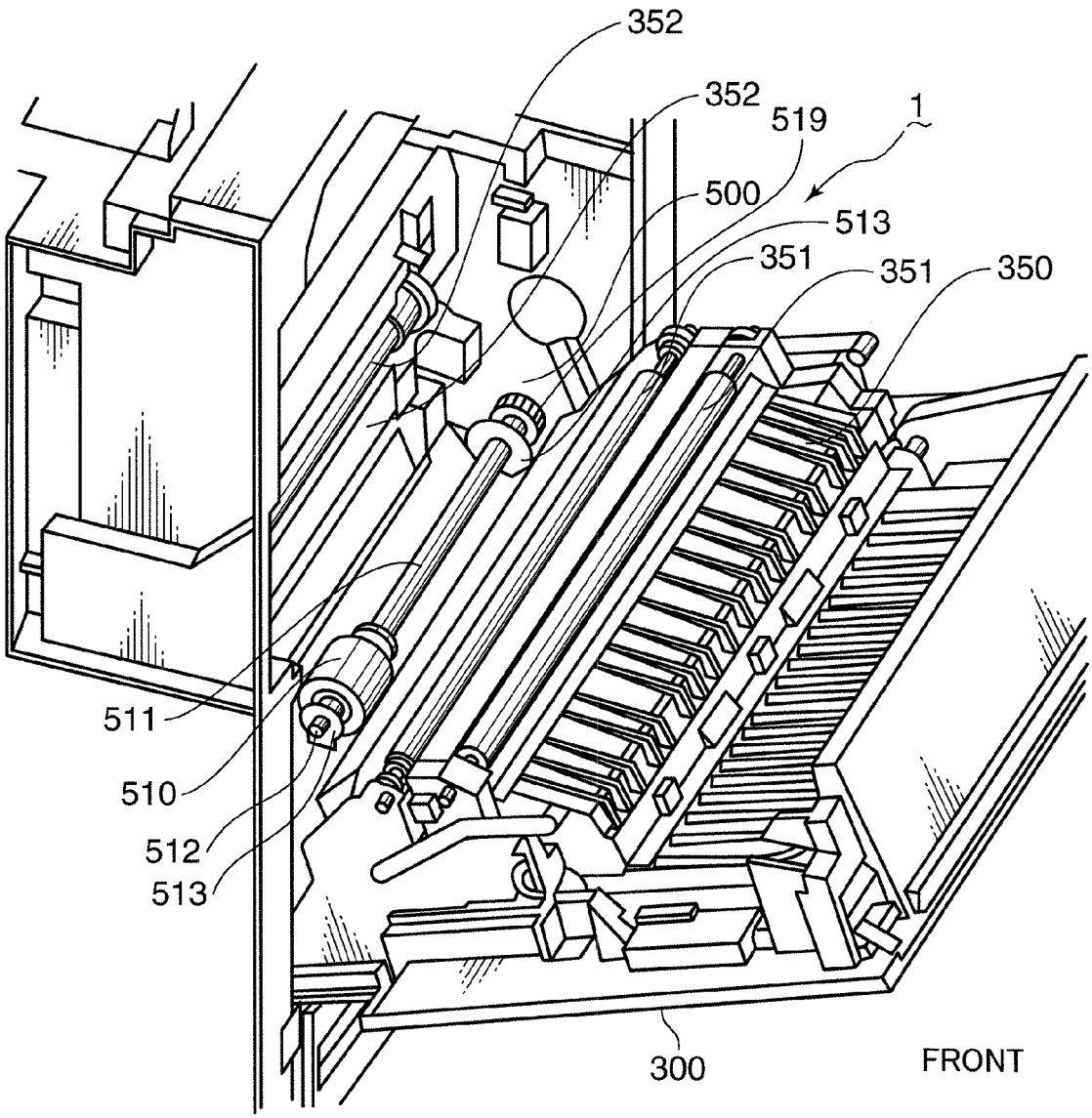
FIG. 3 is a schematic perspective view of a feed assembly incorporated into the image forming apparatus shown in FIG. 1.

FIG. 3 is a perspective view of the color printer 1 in which an internal cover 350 adjacent to the feed tray 300 shown in FIG. 2 is rotated to the front side. As shown in FIG. 3, when the feed tray 300 and the internal cover 350 are pulled down to the front side, the feed assembly 500 is exposed, so that a user may carry out a replacement operation for the feed assembly 500. The feed assembly 500 is described here with reference to FIGS. 2 and 3.

As shown in FIG. 2, the internal cover 350 includes an inner surface which defines a sheet conveyance path. As shown in FIG. 3, several rollers 351 are mounted on the inner surface of the internal cover 350.

The housing 90 comprises a confronting surface which confronts the inner surface of the internal cover 350 and rollers 352 which are mounted on the confronting surface. The rollers 352 face the rollers 351. The paired rollers 351 and 352 convey a sheet. A user may pull down the internal cover 350 toward the front side to expose the feed assembly 500.

The feed assembly 500 includes a feed roller 510, a drive shaft 511 configured to transmit drive force for driving the feed roller 510 and an idle shaft 512 configured to support the feed roller 510. The feed roller 510 includes a drive end connected to the drive shaft 511 and an idle end connected to the idle shaft 512.

The feed assembly 500 also comprises a pair of brackets 513 configured to support the drive shaft 511 and the idle shaft 512, respectively. The idle shaft 512, the feed roller 510 and the drive shaft 511 extend in the width direction of the sheet.

The feed assembly 500 also comprises a gear 519 attached to an end of the drive shaft 511 and a drive source (for example, motor) including a drive shaft configured to engage with the gear 519. The feed roller 510 and the drive shaft 511 integrally rotate according to operation of the drive source.

Figure 4:
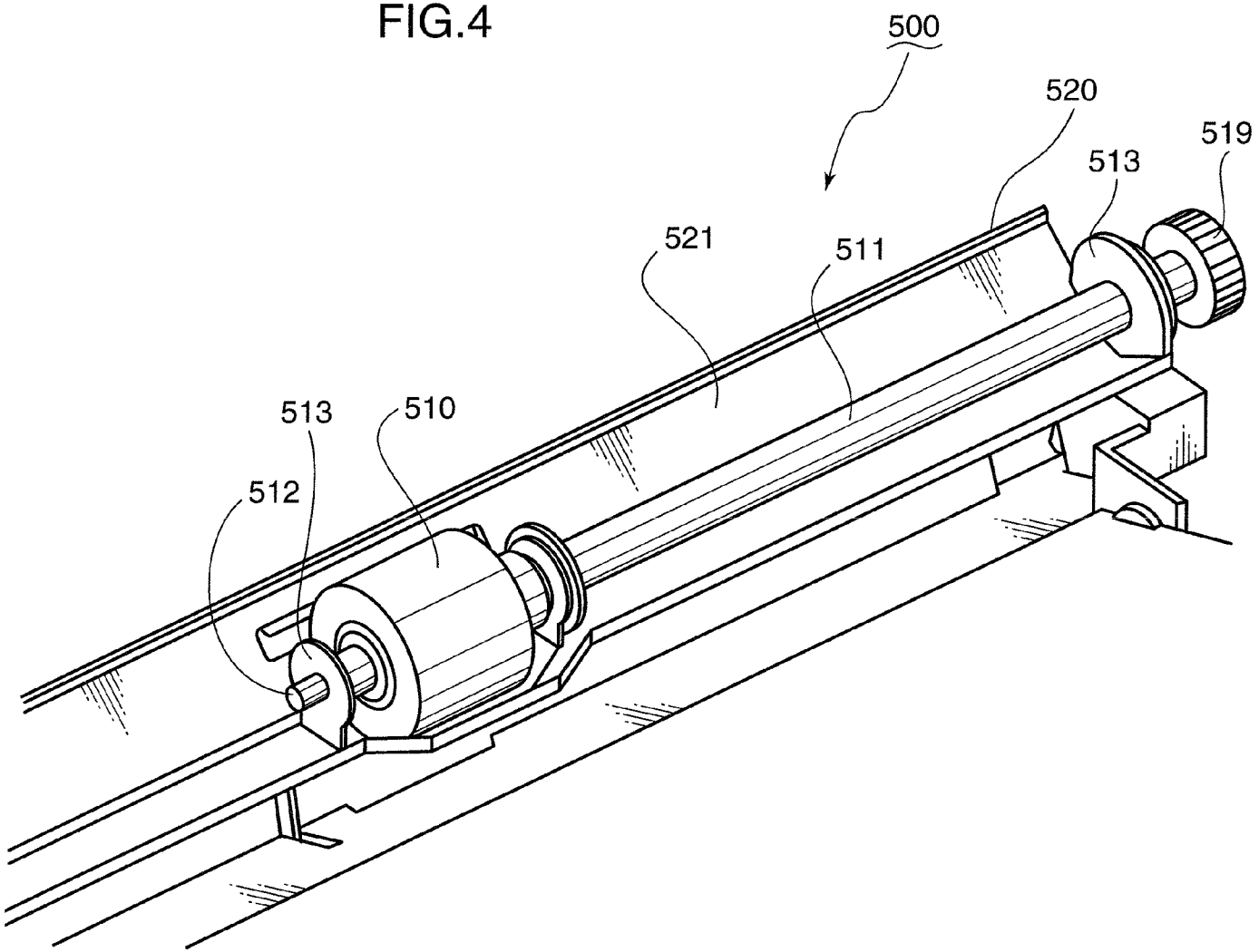
FIG. 4 is an enlarged schematic perspective view of the feed assembly shown in FIG. 3.

FIG. 4 is an enlarged perspective view of the feed assembly 500. The feed assembly 500 is described further here with reference to FIGS. 3 and 4.

The feed assembly 500 also comprises a base 520. The base 520 includes a guide surface 521 which is curved so as to partially surround the idle shaft 512, the feed roller 510 and the drive shaft 511. The guide surface 521 extends upwards and guides the conveyed sheet so that the sheet moves upwardly. The feed roller 510 rotates in contact with the sheet conveyed on the guide surface 521. The brackets 513 configured to support the drive shaft 511 and the idle shaft 512 stands above the guide surface 521. The base 520 supports the drive shaft 511 and the idle shaft 512 via the brackets 513.

Figure 5C:
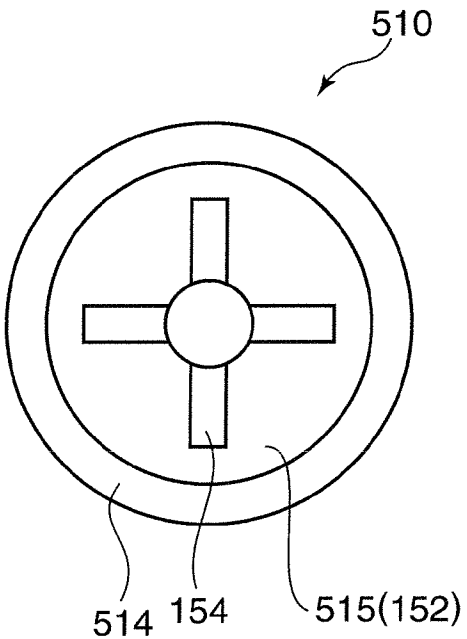
FIG. 5C is a schematic side view showing the feed roller of the feed assembly shown in FIG. 4.
Figure 5A:
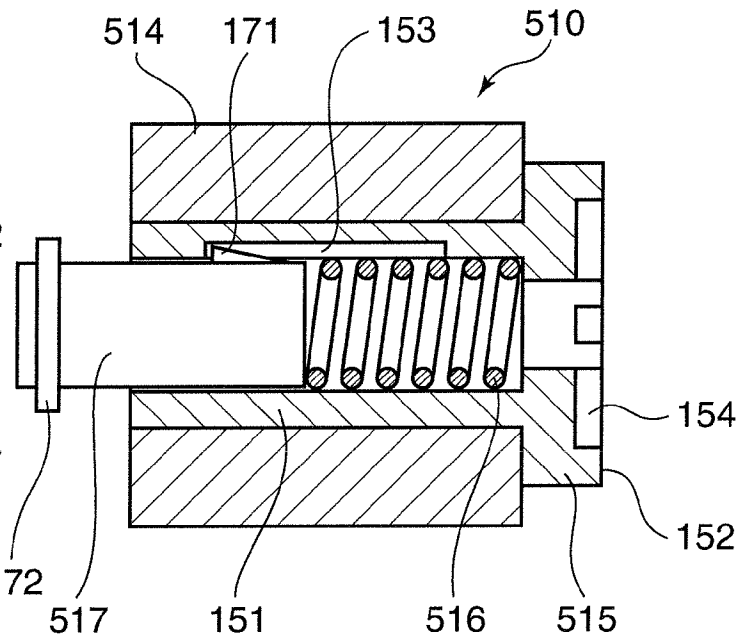
FIG. 5A is a schematic cross-sectional view showing a feed roller of the feed assembly shown in FIG. 4.
Figure 5B:
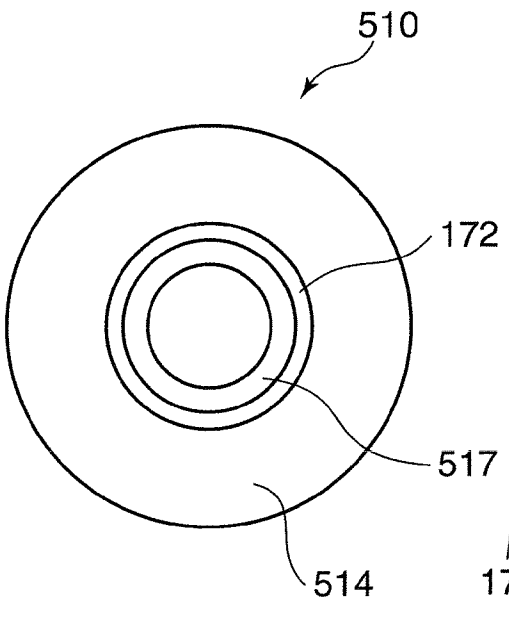
FIG. 5B is a schematic side view showing the feed roller of the feed assembly shown in FIG. 4.

FIG. 5A is a schematic cross-sectional view of the feed roller 510. FIG. 5B is a schematic side view of the feed roller 510 which shows a connecting portion with the idle shaft 512. FIG. 5C is a schematic side view of the feed roller 510 which shows a connecting portion with the drive shaft 511. The feed roller 510 is described with reference to FIG. 4 and FIGS. 5A to 5C.

The feed roller 510 comprises a substantially cylindrical conveyance tube 514 in contact with the sheet and a substantially two-step cylindrical drive piece 515 inserted into the conveyance tube 514. The drive piece 515 integrally rotates with the conveyance tube 514. The feed roller 510 also comprises a coil spring 516 accommodated inside the drive piece 515 and a substantially cylindrical idle piece 517 inserted into the drive piece 515. The idle piece 517 is biased by the coil spring 516.

The conveyance tube 514 is made of a material with a sufficiently higher coefficient of friction to convey the sheet (for example, a cork material). The drive piece 515 comprises a substantially cylindrical insert section 151 inserted into the conveyance tube 514 and a substantially circular connecting disk 152 which is larger in diameter than the insert section 151. The connecting disk 152 appears on a side of the drive shaft 511. The insert section 151 includes an inner circumferential surface in which an engaging groove 153 is formed. The engaging groove 153 extends in a longitudinal direction of the insert section 151. The connecting disk 152 includes, for example, a connecting surface in which a substantially crossed engaging groove 154 is formed. The drive shaft 511 comprises an end surface connected to the connecting surface of the connecting disk 152. A crossed projection (not illustrated) which is complementary with the engaging groove 154 is formed in the end surface of the drive shaft 511. As a result of the engagement between the engaging groove 154 and the crossed projection of the drive shaft 511, rotation of the drive shaft 511 is transmitted to the drive piece 515. An outer circumferential surface of the insert section 151 may generate a sufficient frictional force with respect to the conveyance tube 514 to integrally rotate the drive piece 515 and the conveyance tube 514. Alternatively, the conveyance tube 514 and the insert section 151 may also be connected by means of a suitable fixing piece such as a set bolt. Consequently, the rotation transmitted to the drive piece 515 is then transmitted to the conveyance tube 514.

After insertion of the coil spring 516 into the insert section 151, the idle piece 517 is inserted into the insert section 151. The idle piece 517 includes a substantially triangular rib 171. The rib 171 projecting from an outer circumferential surface of the idle piece 517 is formed near an end of the idle piece 517. A degree of projection of the rib 171 becomes gradually smaller toward the end of the idle piece 517. As a result of engagement between the rib 171 and the engaging groove 153 defined in the insert section 151, the rotation transmitted to the drive piece 515 is further transmitted to the idle piece 517. A annular projection 172 is formed near an end of the idle piece 517 which is connected to the idle shaft 512. The portion between the projection 172 and the end of the idle piece 517 is rotatably supported by the idle shaft 512. The rib 171 is caught by an end of the engaging groove 153 when the idle piece 517 is in a projecting position where the idle piece 517 is pushed out from the insert section 151 by the coil spring 516. Meanwhile, the projection 172 is apart from an end surface of the conveyance tube 514 and/or the insert section 151. A user may push the idle piece 517 into the insert section 151 up to an accommodated position where the projection 172 makes contact with the end surface of the conveyance tube 514 and/or the insert section 151. It should be noted that the idle piece 517 of the feed roller 510 shown in FIG. 5 is located in the projecting position.

Figure 6:
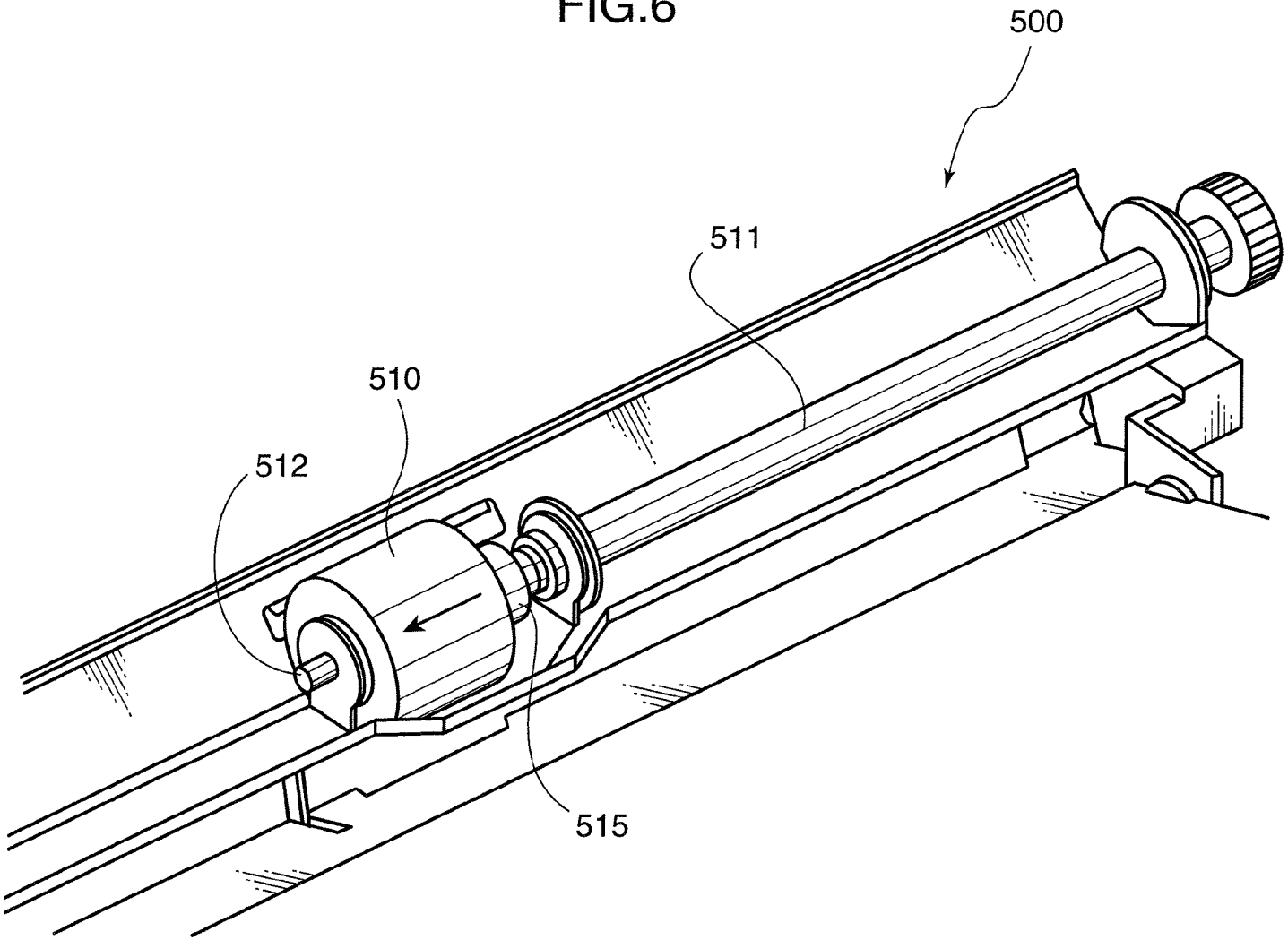
FIG. 6 is a schematic perspective view showing steps for removing the feed roller shown in FIGS. 5A to 5C.
Figure 7:
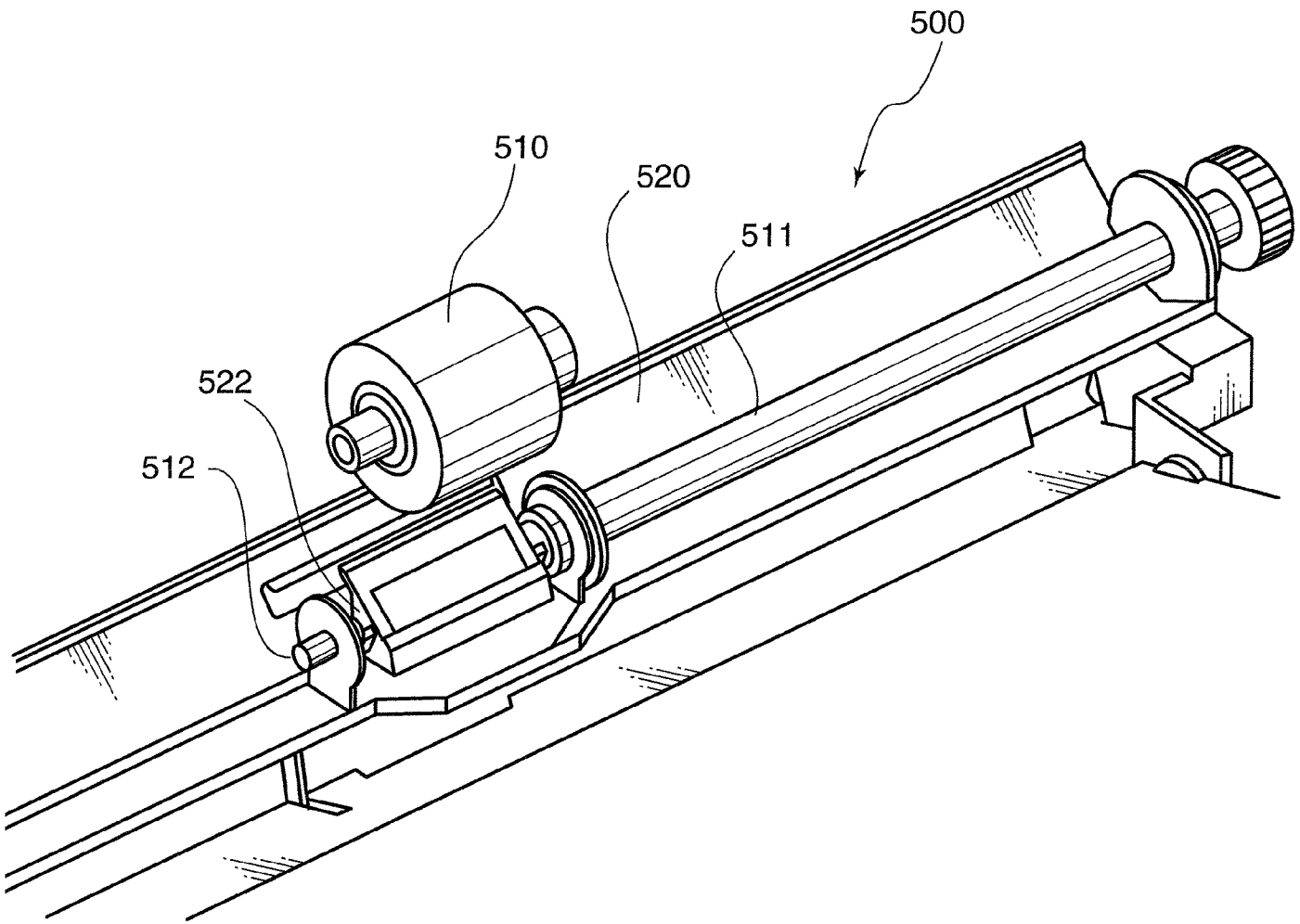
FIG. 7 is a schematic perspective view showing steps for removing the feed roller shown in FIGS. 5A to 5C.

FIG. 6 is a schematic perspective view of the feed roller 510 when the idle piece 517 moves to the accommodated position. FIG. 7 is a schematic perspective view of the feed roller 510 removed from the drive shaft 511 and the idle shaft 512. Steps for removing the feed roller 510 from the drive shaft 511 and the idle shaft 512 are described here with respect to FIGS. 5A to 7.

As shown in FIG. 6, when the feed roller 510 is moved toward the idle shaft 512, the idle piece 517 is moved to the accommodated position as described above. Consequently, the engagement between the drive piece 515 and the drive shaft 511 is released.

As shown in FIG. 7, when the feed roller 510 is subsequently picked up, the feed roller 510 is easily separated from the drive shaft 511 and the idle shaft 512. When the feed roller 510 is removed, a pad 522 which has been pushed into the base 520 by the feed roller 510 is pushed upwards. In the present embodiment, the drive shaft 511 and/or the idle shaft 512 are exemplified as a support element configured to support the feed roller 510. Alternatively, any desirable structure configured to detachably and rotatably support the feed roller 510 may be used as a support element.

Figure 8:
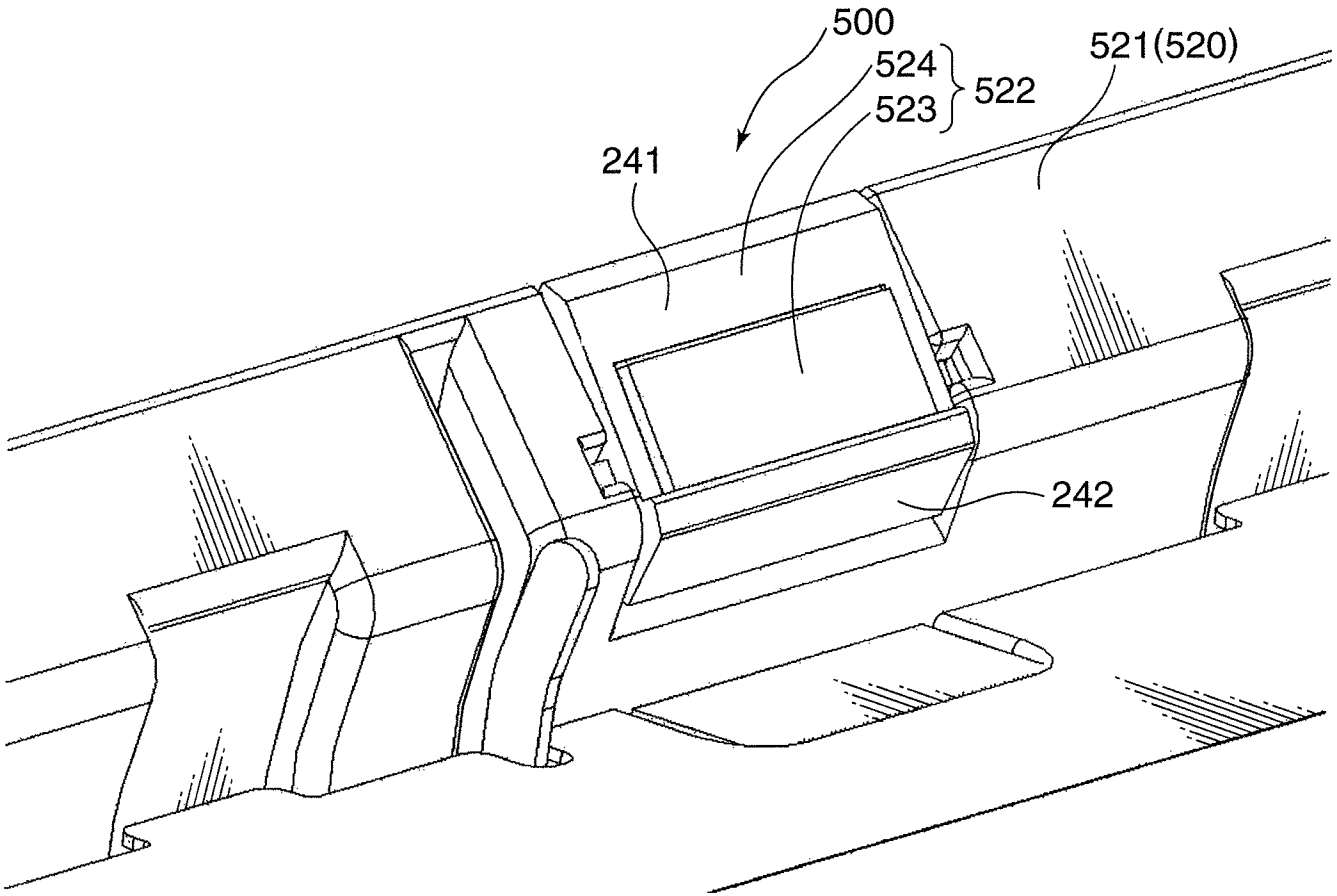
FIG. 8 is a schematic perspective view of a pad in contact with the feed roller shown in FIGS. 5A to 5C.

FIG. 8 is a schematic perspective view of the pad 522 pushed into the base 520 by the feed roller 510. The pad 522 is described here with reference to FIGS. 7 and 8.

The pad 522 comprises a substantially square pad piece 523 and a holder 524 configured to support the pad piece 523. The pad piece 523 partially surrounded by the holder 524 applies a given frictional force to the sheet to impede downstream conveyance of excessive sheets. Therefore, even if overlapped sheets are conveyed, only a sheet in contact with the feed roller 510 is conveyed downstream, whereas the pad piece 523 impedes downstream conveyance of remaining sheets. The pad piece 523 and a surface of the holder 524 adjacent to a perimeter edge of the pad piece 523 form a substantially flush surface with the guide surface 521 of the base 520. The pad piece 523 is desirably made from a more abrasive-resistant material than the feed roller 510 (for example a silicon board). By using the more abrasive-resistant material for the pad piece 523, the pad 522 is less frequently replaced.

Figure 9:
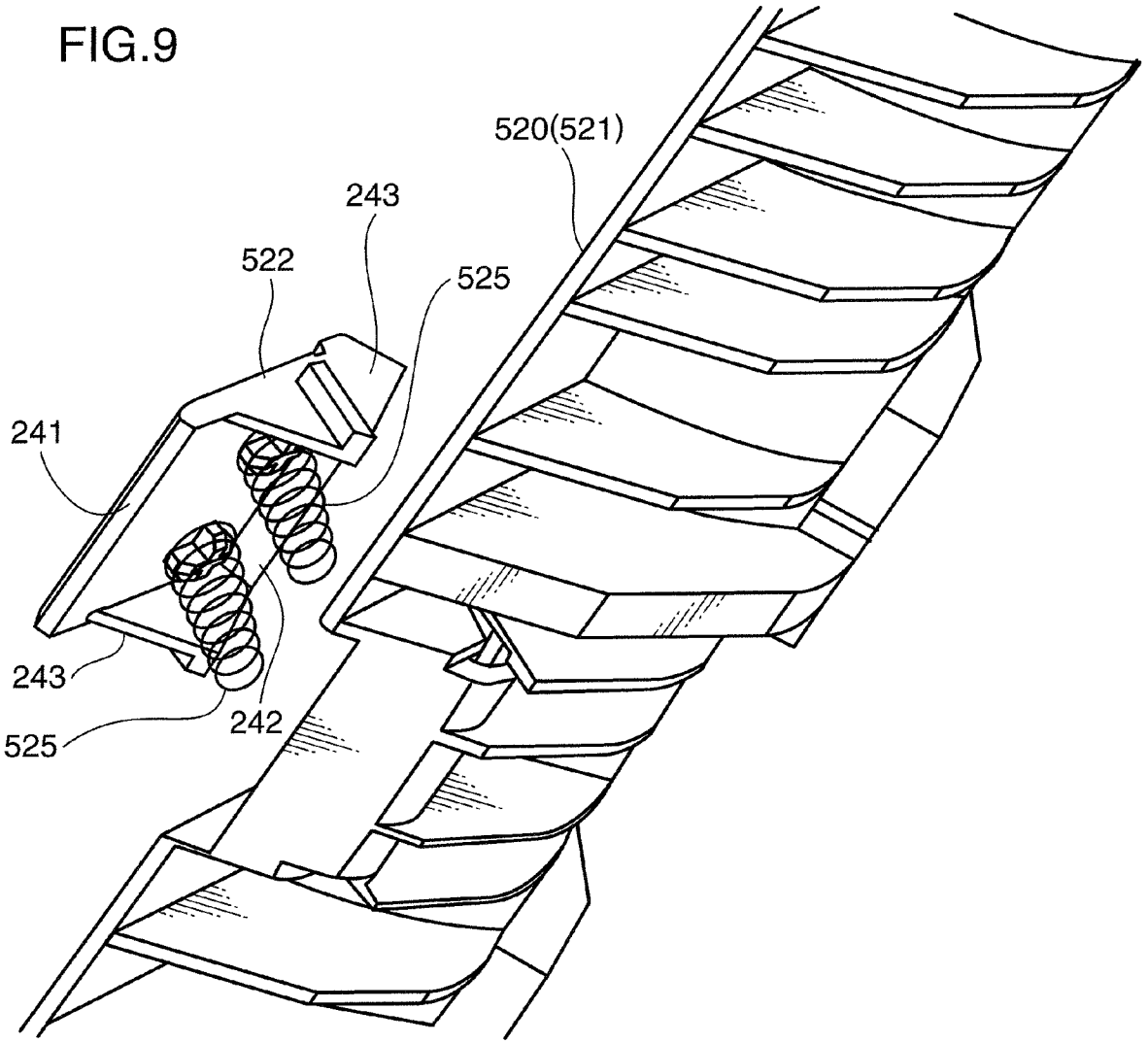
FIG. 9 is a schematic perspective bottom view of the pad shown in FIG. 8.

FIG. 9 is a schematic perspective view of the pad 522 after the removal of the feed roller 510. Step for removing the pad 522 are described here with reference to FIGS. 7 to 9.

As shown in FIG. 9, the feed assembly 500 also comprises a pair of coil springs 525 configured to connect the pad 522 to the base 520.

As shown in FIG. 8, while the pad 522 pushed into the base 520 by the feed roller 510 lies flush with the guide surface 521, the coil springs 525 push the pad 522 (pad piece 523) against the feed roller 510. Thus, even if a surface of the pad piece 523 is slightly worn, the pad 522 may still continue to apply a frictional force to a sheet.

As shown in FIG. 7, when the feed roller 510 is removed, the coil springs 525 between the pad 522 and the base 520 push the pad 522 upwards, so that the pad 522 is projected from the guide surface 521. In the present embodiment, the coil springs 525 connect the pad 522 to the base 520. Alternatively, a suitable elastic member or structure, which has pushed the pad 522 against the feed roller 510, may lift the pad 522 further upwards after the removal of the feed roller 510. Such elastic member or structure may be preferably used to connect the pad 522 with the base 520.

Figure 10:
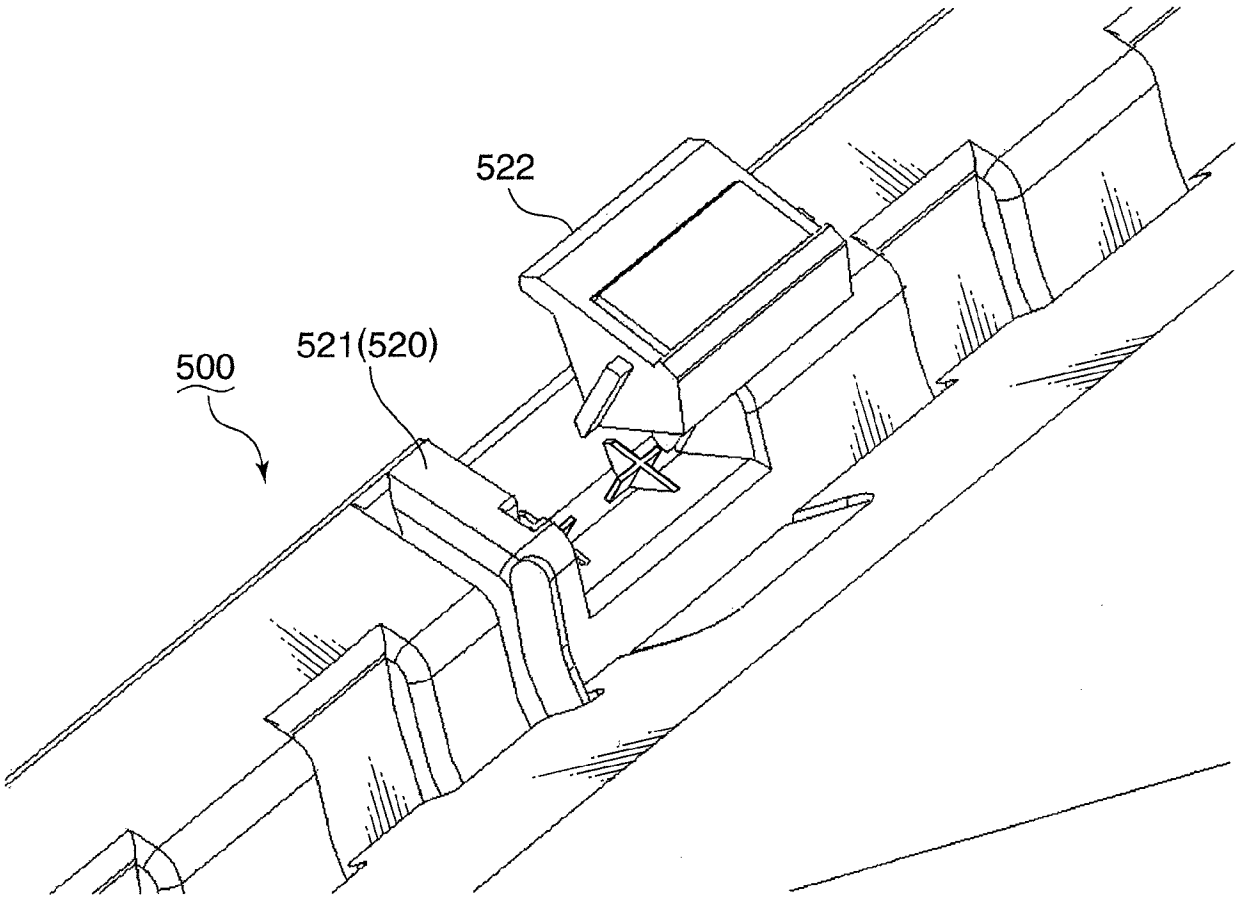
FIG. 10 is a schematic perspective view showing steps for removing the pad shown in FIG. 8.

FIG. 10 is a schematic perspective view of the feed assembly 500 after removal of the coil springs 525. Further description for the steps for removing the pad 522 is given here with reference to FIGS. 9 and 10.

As described above, since the coil springs 525 lift up the pad 522 beyond the guide surface 521, then the user may easily pick the pad 522. The user may then pull out the pad 522 from the base 520 and remove the coil springs 525. The user may therefore readily separate and remove the pad 522 from the base 520. The projection of the pad 522 directly shows the user that the pad 522 is a component to be replaced. Consequently, even a less experienced user may appropriately replace the pad 522 without reading an operating manual.

Figure 11:
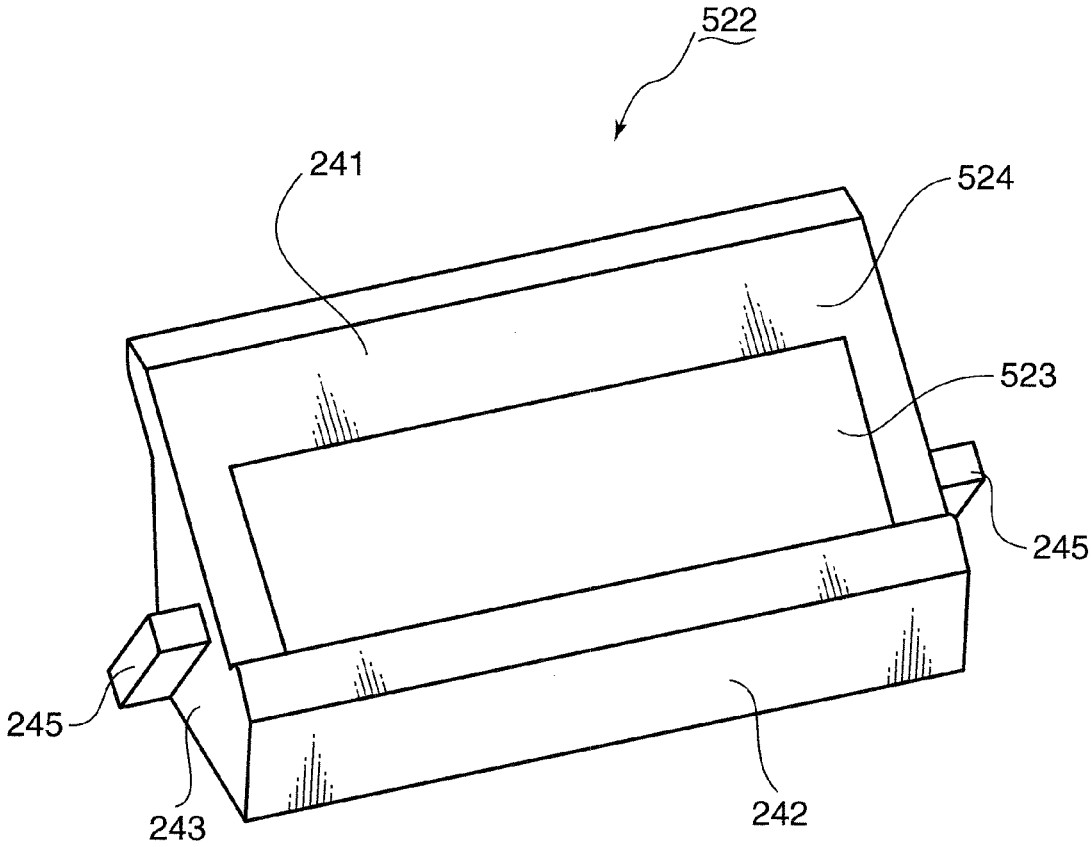
FIG. 11 is a schematic perspective top view of the pad shown in FIG. 8.
Figure 12:
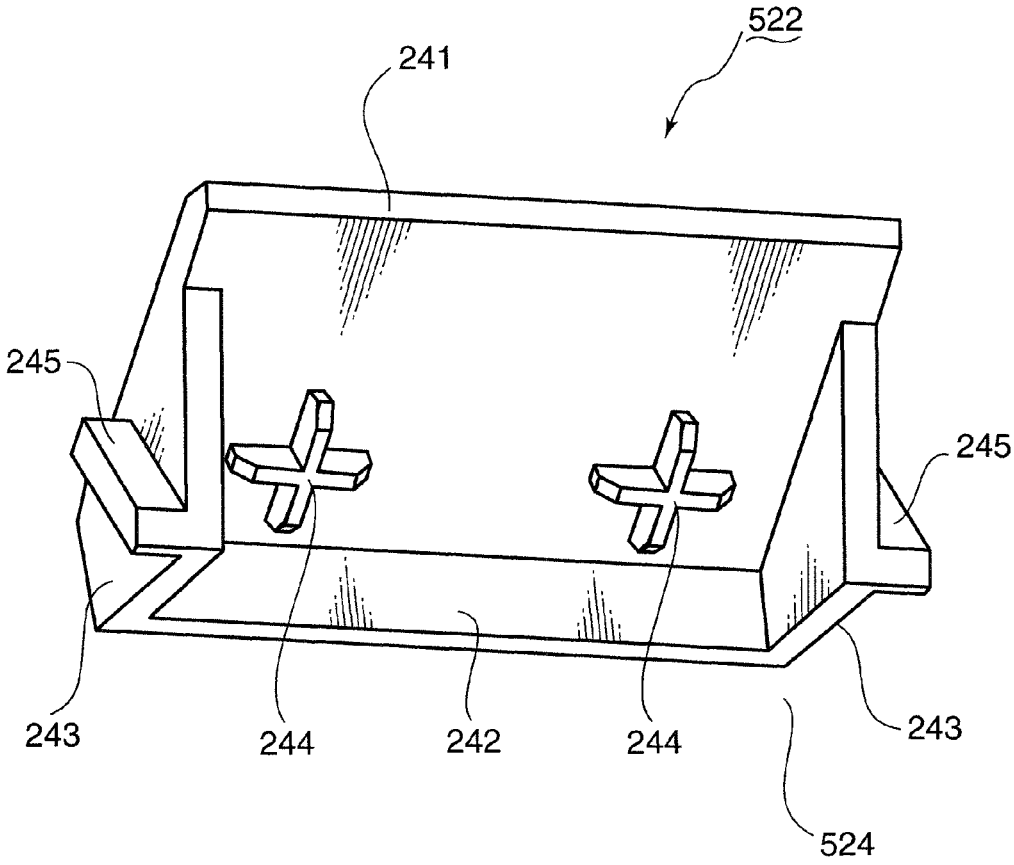
FIG. 12 is a schematic perspective bottom view of the pad shown in FIG. 11.

FIG. 11 is a schematic perspective top view of the pad 522. FIG. 12 is a schematic perspective bottom view of the pad 522. The pad 522 is described here with reference to FIGS. 8, 9, 11 and 12.

The holder 524 of the pad 522 comprises a substantially square main plate 241, a substantially square upstream wall 242 extending downwardly from an upstream edge of the main plate 241 and trapezoidal side plates 243 extending downwardly from both side edges of the main plate 241, respectively. An upper surface of the main plate 241 partially forms the guide surface 521. A recess complementary with the pad piece 523 is formed in the upper surface of the main plate 241. The pad piece 523 is buried in the recess. The upper surface of the pad piece 523 preferably lies substantially flush with the upper surface of the main plate 241.

The main plate 241 includes a pair of projections 244. The substantially crossed projections 244 project from a lower surface of the main plate 241. An upper ends of the coil springs 525 is wound around the projections 244. Therefore, the coil springs 525 and the holder 524 may be easily separated. The main plate 241, the upstream wall 242 and the paired side plates 243 form a room for accommodating the coil springs 525. The paired side plates 243 comprise substantially a linear rib 245, respectively. The rib 245 projects from an outer surface of the side plate 243. In the present embodiment, the upper end of the coil spring 525 is exemplified as a first spring end.

Figure 13:
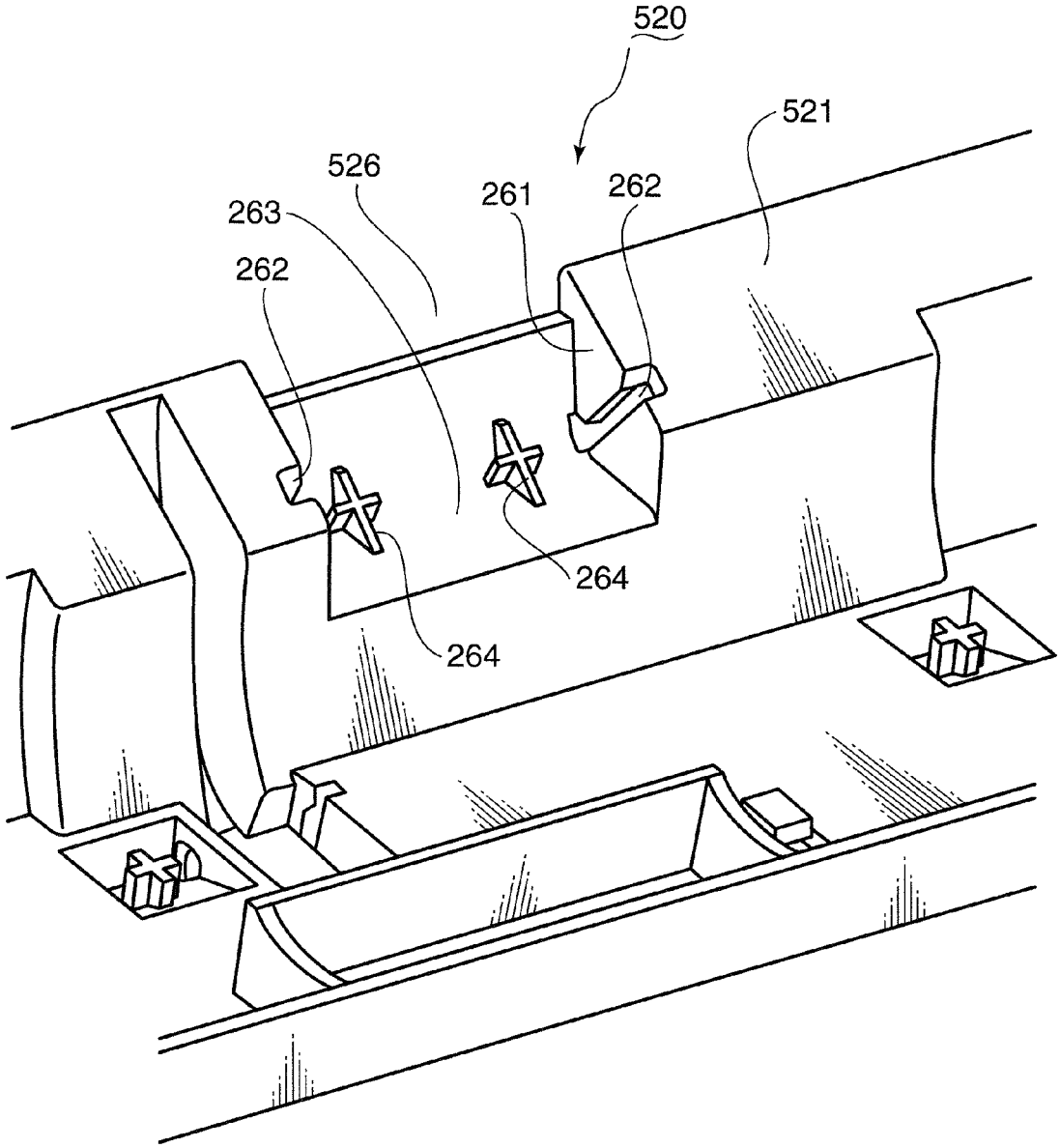
FIG. 13 is a schematic perspective view showing a recess for accommodating the pad shown in FIG. 11.

FIG. 13 is a perspective view of the base 520. The base 520 is described here with reference to FIGS. 4, 9, 11 and 13.

A recess 526 is formed in the guide surface 521 of the base 520. The recess 526 is substantially complementary with the pad 522. The pad 522 is accommodated in the recess 526. As described above, when the pad 522 is accommodated in the recess 526, the upper surface of the main plate 241 of the pad 522 and the upper surface of the pad piece 523 may guide the sheet together with the guide surface 521 of the base 520.

A groove 262 substantially complementary with the rib 245 formed in the side plate 243 of the pad 522 is formed in a surface of each side wall 261 of the base 520 which defines a side surface of the recess 526. The ribs 245 of the pad 522 engage with the grooves 262. Since the grooves 262 guide the ribs 245, the pad 522 is readily and accurately accommodated in the recess 526. The grooves 262 and the ribs 245 of the pad 522, which is accommodated in the recess 526, extend toward a rotational axis of the feed roller 510.

A bottom wall 263 of the base 520 which defines a bottom surface of the recess 526 comprises a pair of projections 264. The substantially crossed projections 264 project from an upper surface of the bottom wall 263. The lower ends of the coil springs 525 are wound around the paired projections 264, respectively. Therefore, the coil springs 525 are easily removed from the base 520. In the present embodiment, the lower end of the coil spring 525 is exemplified as a second spring end.

Figure 14:
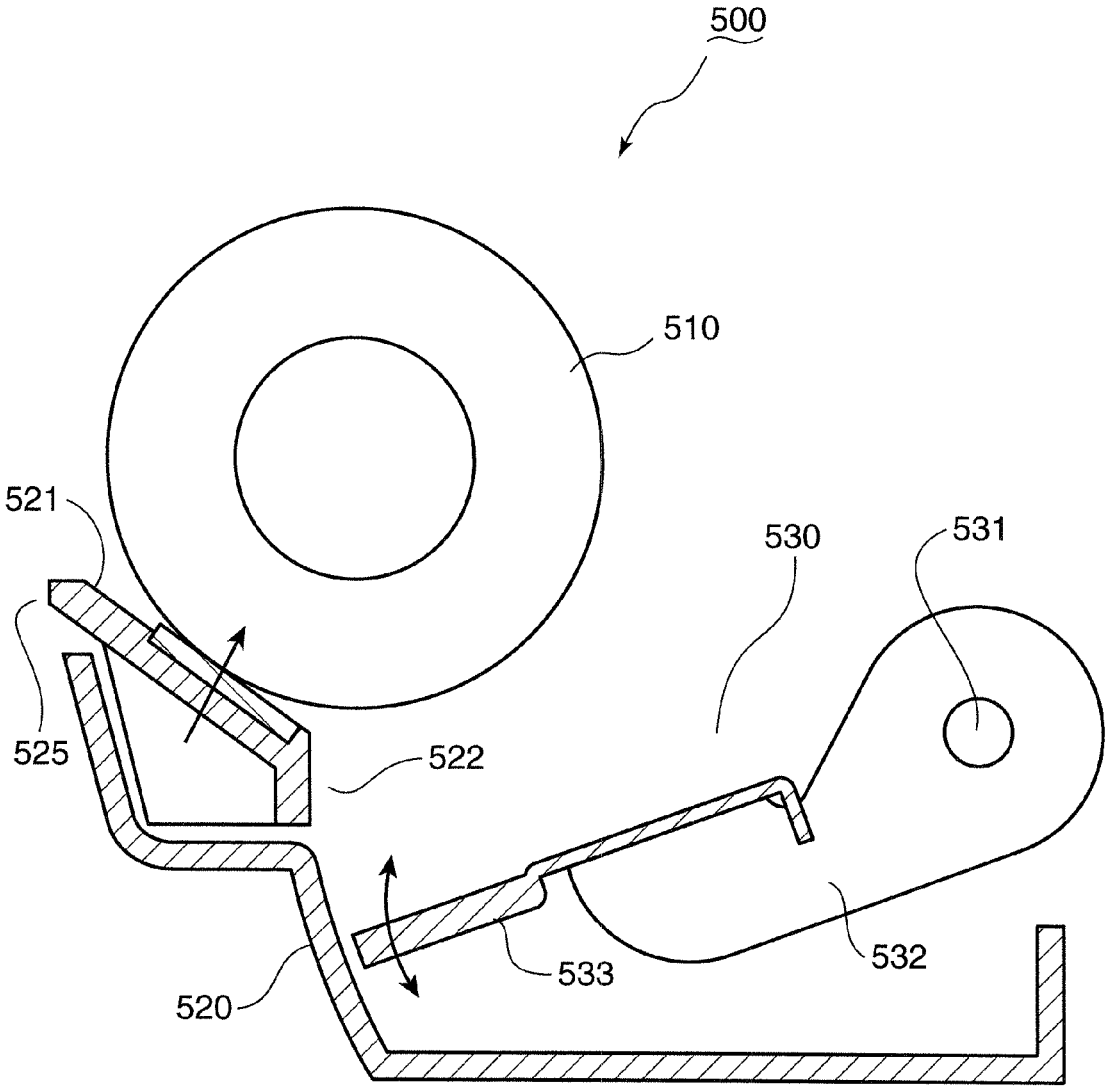
FIG. 14 is a schematic cross-sectional view of the feed assembly shown in FIG. 4.

FIG. 14 is a schematic cross-sectional view of the feed assembly 500. Operation of the feed assembly 500 is described here with reference to FIGS. 11, 13 and 14.

The feed assembly 500 also comprises a lift plate 530, in addition to the feed roller 510 and the base 520. The base 520 shown in FIG. 14 forms a whole housing of the feed assembly 500. Alternatively, the base 520 may partially form the housing of the feed assembly 500. The lift plate 530 comprises an arm 532 with a base end supported on rotating shafts 531 and a pressing plate 533 attached to a tip of the arm 532. The arm 532 extends downstream from the base end. The pressing plate 533 extends further downstream from the tip of the arm 532. Furthermore, the pressing plate 533 also extends in the width direction of the sheet. The lift plate 530 rotates upwards about the rotating shafts 531. While a sheet is being conveyed, the lift plate 530 presses the leading edge of the sheet against the circumferential surface of the feed roller 510. Thus, the sheet is fed to the more downstream guide surface 521 than the lift plate 530.

As described above, due to the biasing force of the coil springs 525 and the engagement between the ribs 245 of the pad 522 and the grooves 262 of the side walls 261 defining the recess 526 in the base 520, the pad 522 is pushed upwards toward the rotational axis of the feed roller 510 (see an arrow in FIG. 14). Consequently, the sheet is nipped between the pad 522 and the feed roller 510. Therefore, the sheets may be conveyed downstream one by one without the conveyance of excessive sheets.

Second Embodiment

Figure 15:
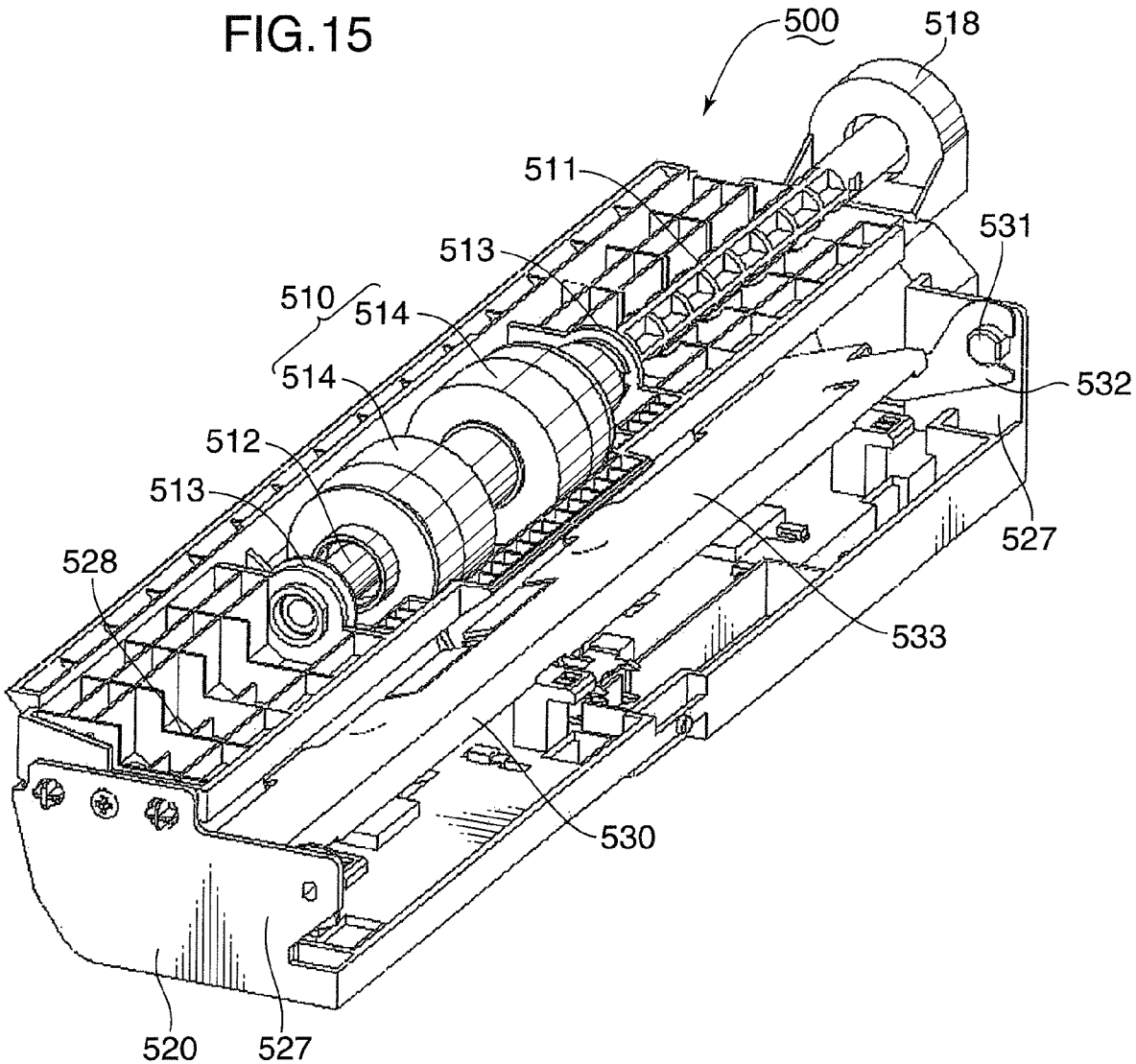
FIG. 15 is a schematic perspective view of a feed assembly according to a second embodiment.

FIG. 15 is a perspective view of a feed assembly 500 according to a second embodiment. A structure of the feed assembly 500 to be described in the context of FIG. 15 is substantially similar to the structure of the feed assembly 500 described in details in the context of FIGS. 3 to 14, and hence explanation below principally focuses on different points from the first embodiment.

The feed assembly 500 comprises a feed roller 510, a base and a lift plate 530. The base 520 forms a substantially boxed housing. The lift plate 530 includes a rotating shaft 531 projecting inwardly from an inner surface of the side wall 527 of the base 520. A base end of an arm 532 of the lift plate 530 divides into two limbs configured to hold the rotating shaft 531, so that the lift plate 530 may vertically rotate. Each of the arms 532 adjacent to a pair of side walls 527 support a pressing plate 533 extending in the width direction of the sheet.

The feed roller 510 comprising a pair of conveyance tubes 514, an idle shaft 512 and a drive shaft 511 are disposed above a ceiling plate 528 of the base 520. Brackets 513 stand from an upper surface of the ceiling plate 528 near both sides of the feed roller 510, respectively. One of the paired brackets 513 rotatably supports an end of the idle shaft 512 and the other of the brackets 513 supports one end of the drive shaft 511. A gear 519 (see, for example, FIGS. 3 and 4) is attached on the other end of the drive shaft 511. In the feed assembly 500 shown in FIG. 15, the gear 519 is covered with a gear cover 518.

Figure 16:
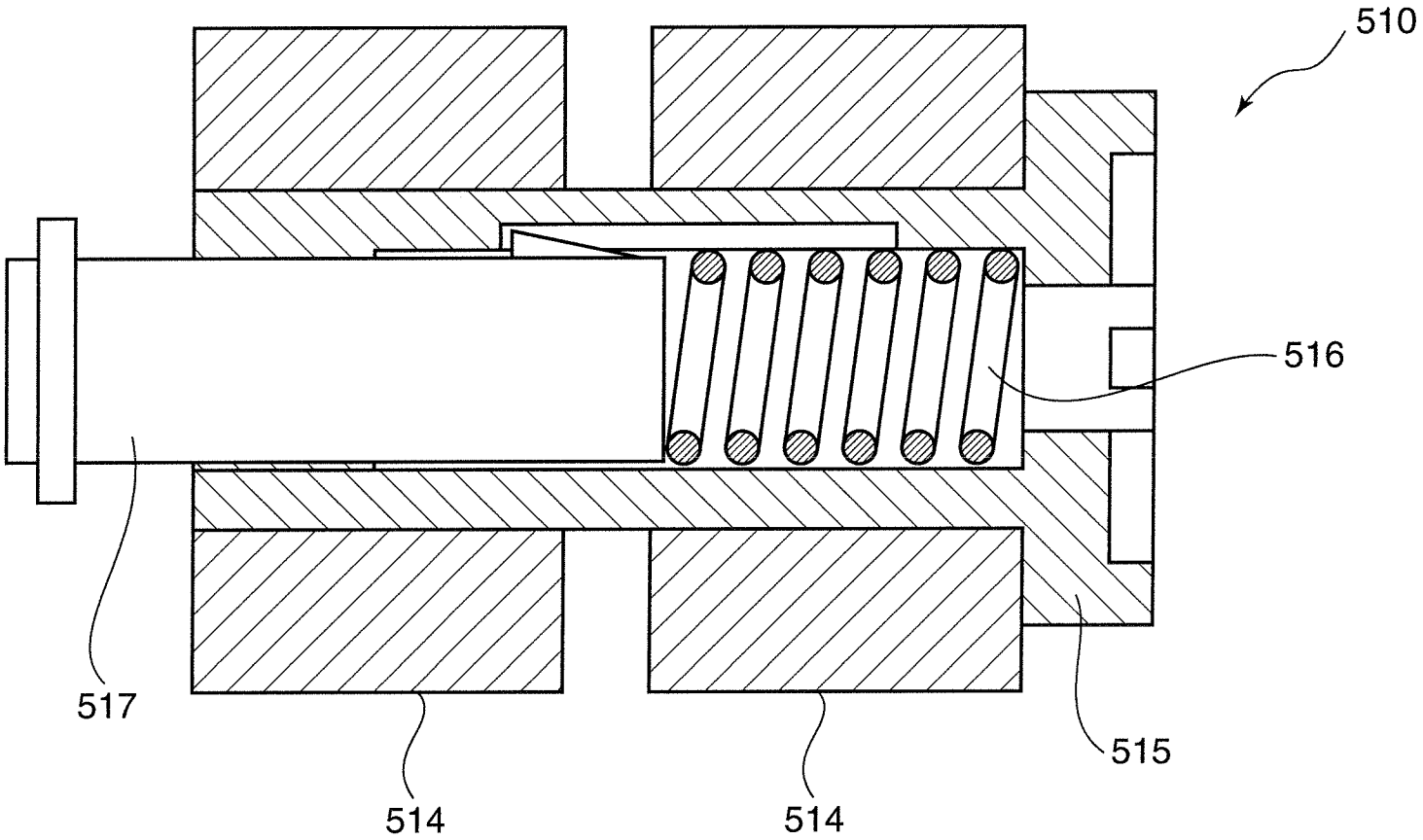
FIG. 16 is a schematic cross-sectional view of a feed roller of the feed assembly shown in FIG. 15.

FIG. 16 is a schematic cross-sectional view of the feed roller 510 shown in FIG. 15. A structure of the feed roller 510 is described here with reference to FIGS. 5A to 7, FIG. 15 and FIG. 16.

Like the structure described in the context of FIGS. 5A to 5C, the feed roller 510 comprises a conveyance tube 514, a drive piece 515, a coil spring 516 and an idle piece 517. The only different point from the structure described in the context of FIGS. 5A to 5C is that two conveyance tubes 514 are mounted on the drive piece 515. Consequently, the feed roller 510 is removed from the drive shaft 511 and the idle shaft 512 by carrying out similar steps to the removal steps described in the context of FIGS. 6 and 7. Alternatively, the feed roller 510 may comprises three or more conveyance tubes 514.

Figure 17:
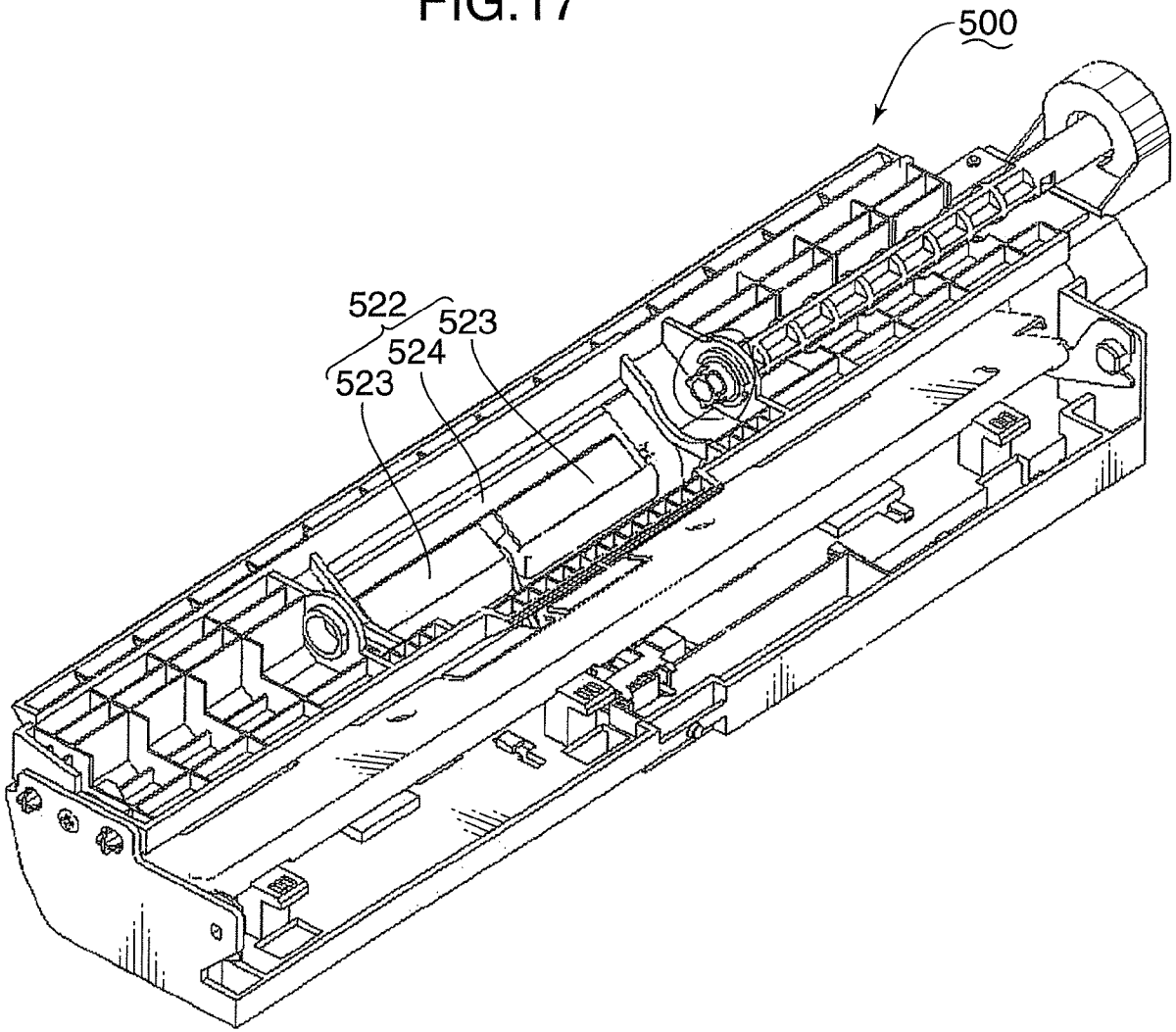
FIG. 17 is a schematic perspective view of a feed assembly without the feed roller shown in FIG. 16.

FIG. 17 is a perspective view of a feed assembly 500 from which the feed roller 510 is removed. Like the first embodiment, the pad 522 is pushed upwards by the coil springs 525. In order to avoid unnecessary complication of the drawings, FIG. 17 shows a pad 522 accommodated inside the recess 526 formed in the base 520. The pad 522 is described here with reference to FIGS. 15 and 17.

As shown in FIG. 17, the pad 522 comprises a pair of pad pieces 523 corresponding to the paired conveyance tubes 514, respectively. The paired pad pieces 523 are surrounded and supported by a single holder 524.

Figure 18:
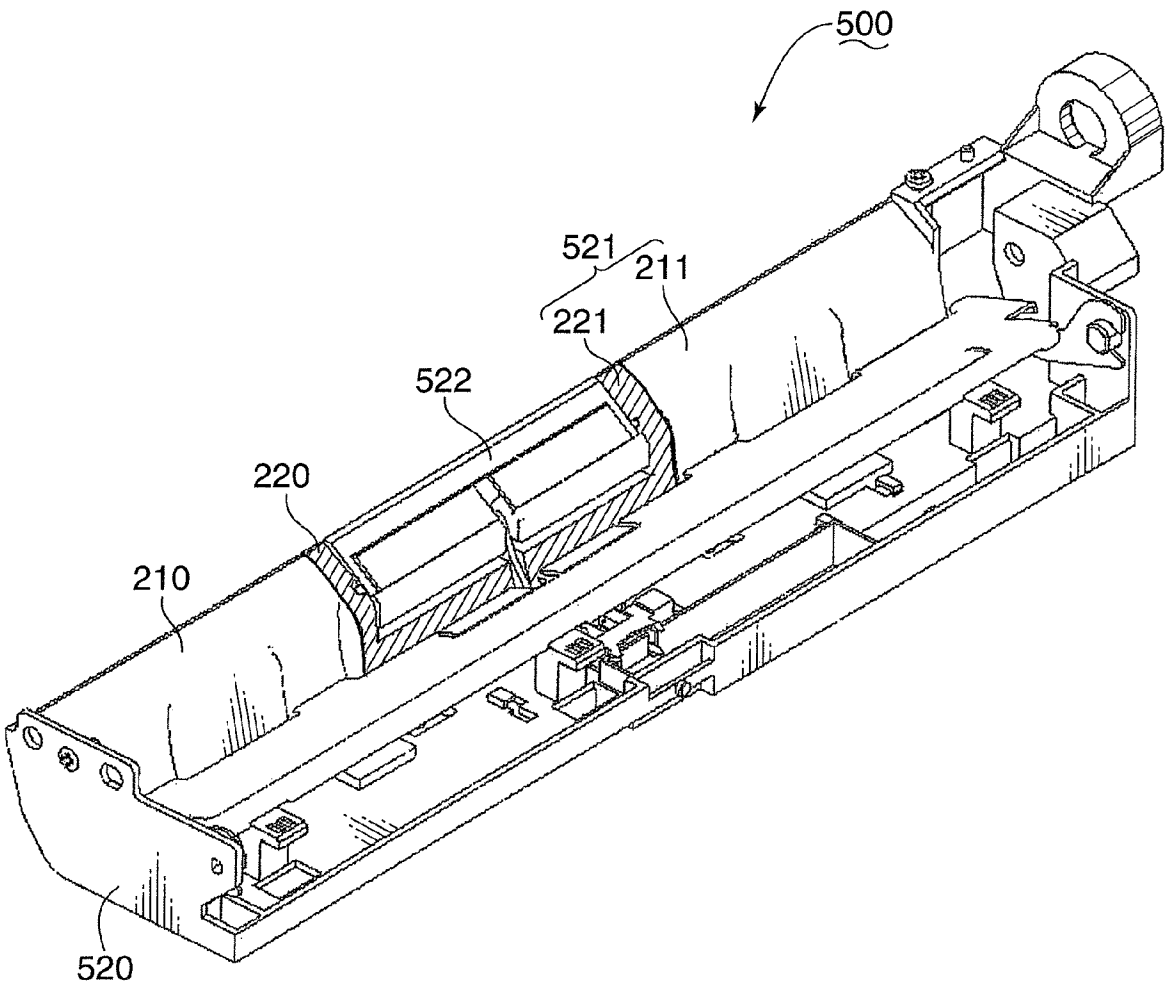
FIG. 18 is a schematic perspective view showing a pad and a movable portion of the feed assembly shown in FIG. 15.

FIG. 18 is a schematic perspective view of the feed assembly 500 in which the ceiling plate 528 and the drive shaft 511 connected to the ceiling plate 528 are removed from the base 520 (housing). As described above, the pad 522 is pushed upwards by the coil springs 525. In order to avoid unnecessary complication of the drawings, FIG. 18 shows the pad 522 accommodated inside the recess 526 formed in the base 520.

The base 520 comprises an immovable portion 210 and a movable portion 220. The movable portion 220 disposed in a center of the feed assembly 500 (a hatched region in FIG. 18) surrounds and also supports the pad 522. The movable portion 220 comprises a movable surface 221 which partially forms the guide surface 521. The immovable portion 210 includes an immovable surface 211 which partially forms the guide surface 521. The immovable surface 211 is adjacent to the left and right of the movable surface 221. The movable surface 221 surrounds the pad 522 accommodated in the recess 526. The movable portion 220 is rotatable with respect to the immovable portion 210.

Figure 19:
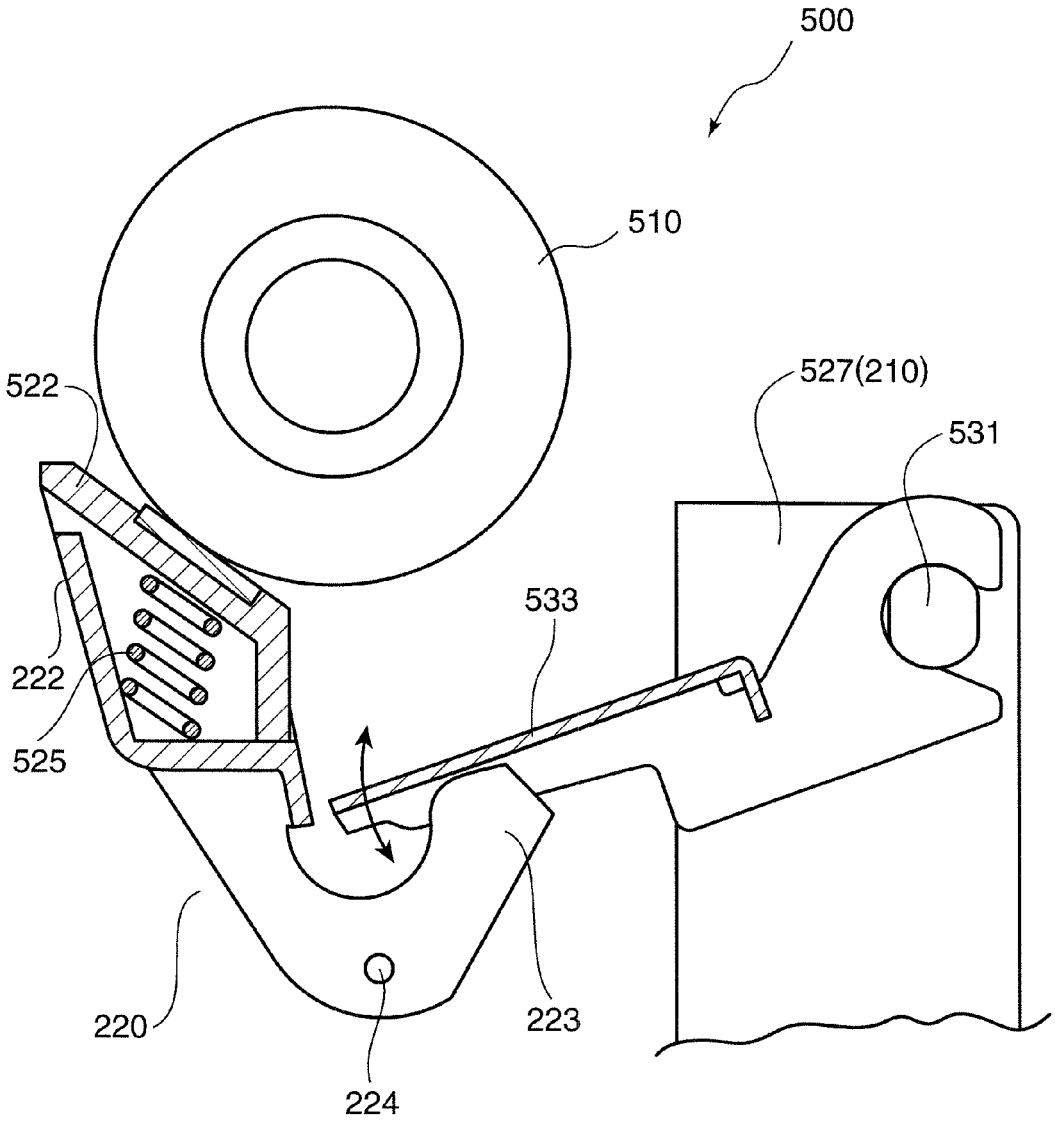
FIG. 19 is a schematic cross-sectional view of the feed assembly shown in FIG. 15.

FIG. 19 is a schematic cross-sectional view of the feed assembly 500 shown in FIG. 15. Operation of the feed assembly 500 is described here with reference to FIGS. 8 to 15, FIG. 18 and FIG. 19.

The lift plate 530 disposed on an upstream side of the pad 522 is rotatably mounted on the immovable portion 210 via rotating shafts 531 projecting from the side walls 527 which partially form the immovable portion 210 of the base 520. Like the operation of the lift plate 530 described in the context of FIG. 14, the lift plate 530 is vertically rotatable. When conveyance of a sheet starts, the lift plate 530 rotates upwards so that a leading edge of the sheet presses against the feed roller 510.

The substantially J shaped movable portion 220 comprises a first end 222 configured to accommodate the pad 522 and a second end 223 opposite to the first end 222. The movable surface 221 (see FIG. 18) is formed on the first end 222. The second end 223 makes contact with a lower surface of the pressing plate 533 of the lift plate 530. Coil springs 525 are provided between the pad 522 and the first end 222. The connection between the first end 222 and the pad 522 is similar to the structure described in the context of FIGS. 8 to 13. A rotating portion 224 is formed in a curved portion between the first end 222 and the second end 223. The rotating portion 224 is rotatably mounted on the immovable portion 210. A wall such as a standing rib inside the base 520 (housing) is exemplified as the immovable portion 210 on which the rotating portion 224 is mounted. When the lift plate 530 rotates upwards and the pressing plate 533 moves apart from the second end 223, the portion from the rotating portion 224 to the first end 222 makes contact with the immovable portion 210 which constitutes the base 520 (housing). Thus, the first end 222 does not move downstream from the position shown in FIG. 19 so that the contact between the pad 522 and the feed roller 510 is maintained.

Figure 20:
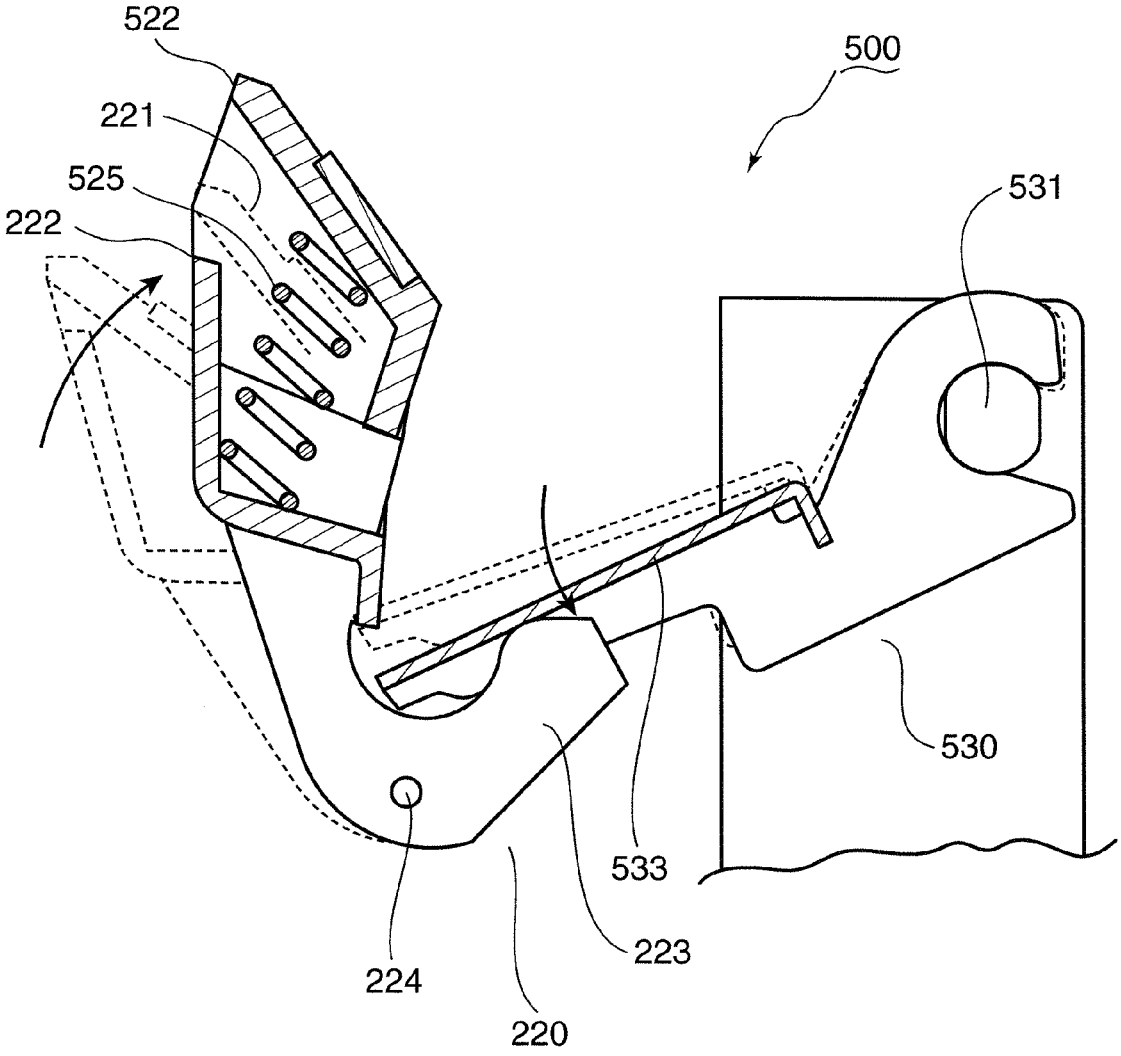
FIG. 20 is a schematic cross-sectional view showing steps for removing a pad of the feed assembly shown in FIG. 15.

FIG. 20 shows operation of the feed assembly 500 after the removal of the feed roller 510. The operation of the feed assembly 500 is described further here with reference to FIG. 20.

When the feed roller 510 is removed, the pad 522 is pushed upward by the coil springs 525. Consequently, the pad 522 projects beyond the first end 222 (movable surface 221) of the movable portion 220. After removing the feed roller 510, the user may press the pressing plate 533 downwards (a departure direction from a position of the feed roller 510) and rotate the lift plate 530 downwards about the rotating shaft 531. Consequently, a lower surface of the pressing plate 533 contacts the second end 223 of the movable portion 220 and then presses further against the second end 223 downwards. The movable portion 220 rotates about the rotating portion 224, with the second end 223 working as a point of effort and the rotating portion 224 working as a fulcrum. The first end 222 of the movable portion 220 lifted up with moving in the upstream direction from a position indicated by dotted lines in FIG. 20 (a position where the movable surface 221 of the movable portion 220 is substantially flush with the immovable surface 211 of the immovable portion 210), so that the first end 222 projects from the immovable surface 211. Consequently, the user may remove the pad 522 yet more easily.

Third Embodiment

Figure 21:
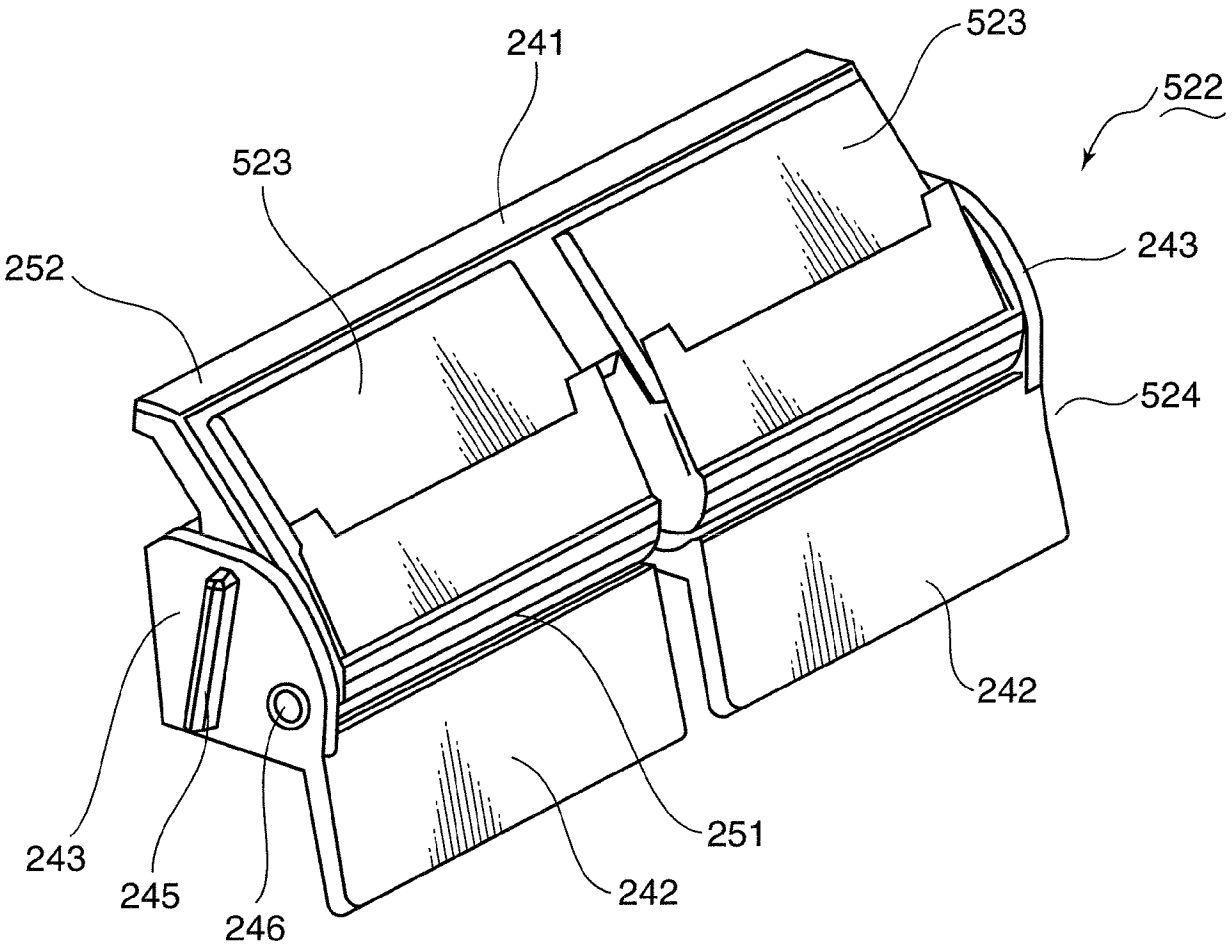
FIG. 21 is a schematic perspective view of a pad used in a feed assembly according to a third embodiment.
Figure 22:
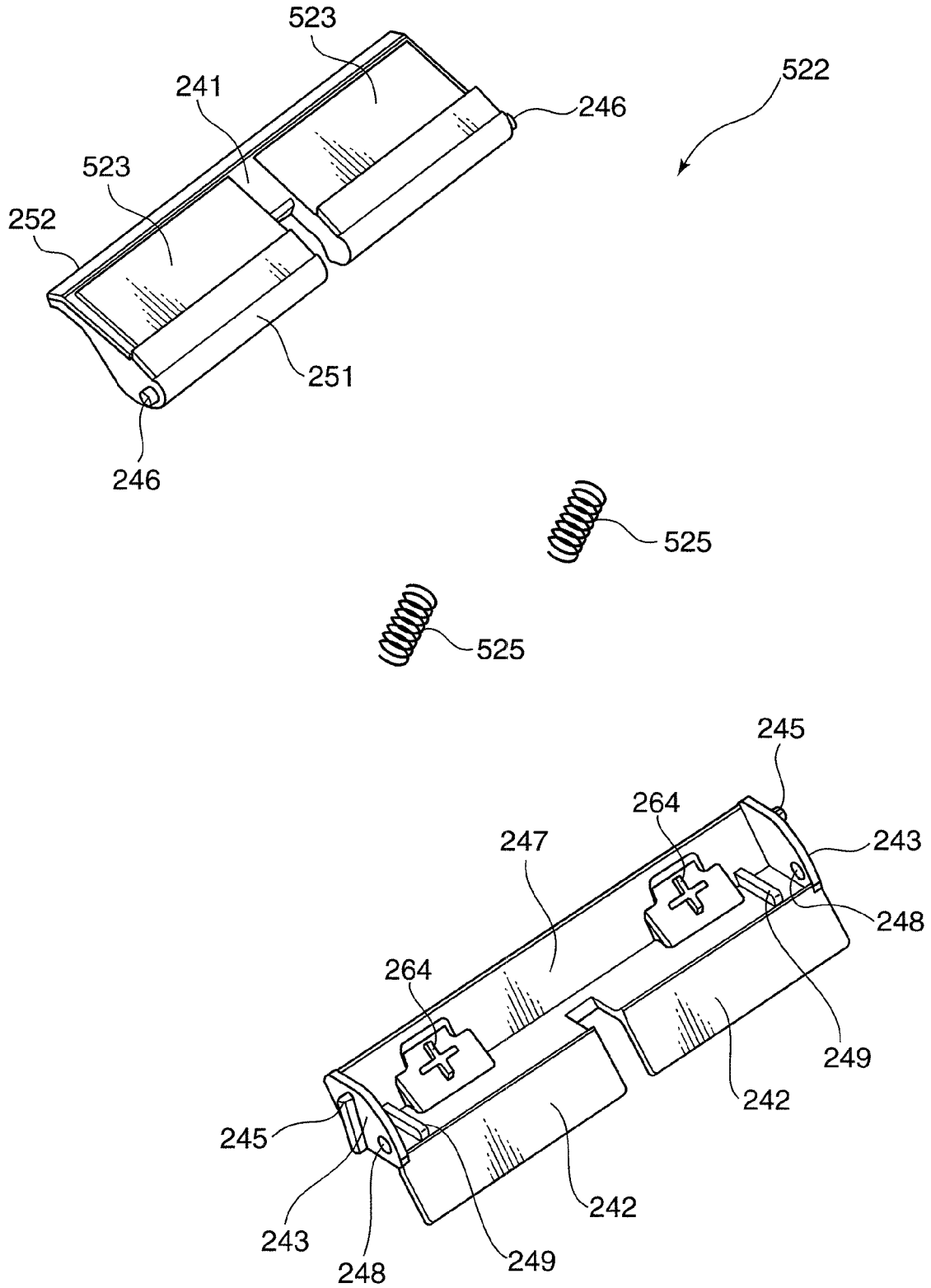
FIG. 22 is an exploded schematic perspective view of the pad shown in FIG. 21.

FIG. 21 is a schematic perspective view of a pad 522 used in a feed assembly 500 according to a third embodiment. FIG. 22 is an exploded perspective view of the pad 522 shown in FIG. 21. The feed assembly 500 according to the third embodiment is similar to the feed assembly 500 according to the first embodiment and/or the second embodiment except for the pad 522. Consequently, a structure of the pad 522 shown in FIG. 21 may be suitably applied to the feed assembly 500 according to the first embodiment and/or the second embodiment.

Like the pad 522 used in the feed assembly 500 according to the first embodiment and/or the second embodiment, the pad 522 used in the feed assembly 500 according to the third embodiment comprises a pad piece 523 configured to generate a frictional force on a sheet and a holder 524 configured to support the pad piece 523. The holder 524 comprises a substantially square main plate 241 configured to support the pad piece 523, a substantially square upstream wall 242 extending downwardly from an upstream side of a main plate 241, a pair of substantially pentagonal side plates 243 extending along both side edge of the main plate 241, respectively, and a back-up plate 247 with an L-shaped cross-section which extends between the paired side plates 243. An upper surface of the main plate 241 partially forms the guide surface 521 configured to guide a sheet, like the main plate 241 of the first embodiment and the second embodiment. A recess complementary with the pad piece 523 is formed in the upper surface of the main plate 241. The pad piece 523 is partially buried in the recess. A number of pad pieces 523 buried in the main plate 241 is not limited in particular, and is set so as to be equal to a number of conveyance tubes 514 of the feed roller 510 used in the feed assembly 500. In the present embodiment, two pad pieces 523 are buried in the main plate 241, and therefore two conveyance tubes 514 are used.

Rotating shafts 246 project from both side edges of the main plate 241, respectively. The rotating shafts 246 are inserted into holes 248 formed in both side plates 243, respectively. The side plates 243 therefore rotatably support the main plate 241. In the present embodiment, an edge of the main plate 241 (the upstream side edge) extending along a rotational axis of the main plate 241 is called the first edge 251. Furthermore, another edge (the downstream side edge) of the main plate 241 opposite to the first edge 251 is called the second edge 252 for the sake of convenience. The second edge 252 is slightly curved toward the downstream side.

Coil springs 525 are provided in an internal space surrounded by the main plate 241, the paired side plates 243 and the back-up plate 247. Like the coil springs 525 described in the context of the first embodiment and the second embodiment, the coil spring 525 biases the main plate 241, so that the main plate 241 rotates toward the feed roller 510 and projects from the guide surface 521.

Paired substantially crossed projections 264 are formed in an inner surface (upper surface) of the back-up plate 247. Like the projections 264 described in the context of FIG. 13, lower ends of coil springs 525 are wound around the projections 264 formed on the inner surface of the back-up plate 247. Therefore, the coil springs 525 are appropriately supported by the back-up plate 247. Furthermore, projections similar to the projections 244 described in the context of FIG. 12 are formed in an inner surface (lower surface) of the main plate 241, and upper ends of the coil springs 525 are wound around these projections. The coil springs 525 connected to the main plate 241 and the back-up plate 247 suitably restrict drop of the pad 522, which may result from restoring action of the coil springs 525.

Ribs 249 upwardly projecting (toward the main plate 241) are formed in the inner surface of the back-up plate 247 extending between lower edges of the paired side plates 243.

In the present embodiment, the ribs 249 are exemplified as a projection configured to halt rotation of the main plate 241 due to the coil springs 525. The rotation of the main plate 241 is halted by an upstream end of the ribs 249 contacting the upstream edge (lower edge) of the inner surface of the main plate 241. Therefore, the main plate 241 is less likely to excessively rotate.

Ribs 245 are formed on outer surfaces of the paired side plates 243, respectively. The ribs 245 guide insertion of the pad 522 into the recess 526 formed in the base 520, similarly to the ribs 245 described in the context of the first embodiment and the second embodiment.

Figure 23A:
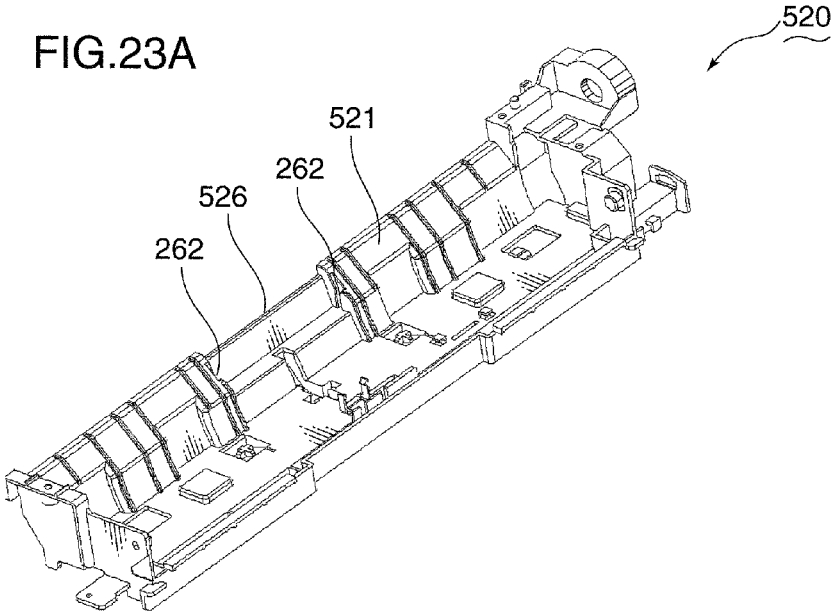
FIG. 23A is a schematic perspective view of a base where the pad shown in FIG. 21 is mounted.
Figure 23B:
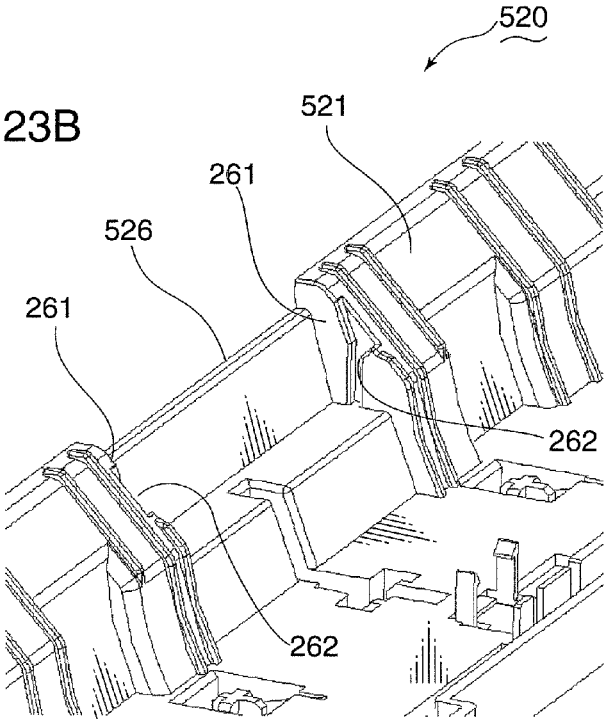
FIG. 23B is a schematic perspective view of a base where the pad shown in FIG. 21 is mounted.

FIG. 23A is a perspective view entirely showing the base 520. FIG. 23B is an enlarged perspective view around a recess 526 for accommodating the pad 522 described in the context of FIGS. 21 and 22. The installation of the pad 522 in the base 520 is described here with reference to FIG. 13, and FIGS. 21 to 23B.

The recess 526 is formed in the guide surface 521 of the base 520. The recess 526 is substantially complementary with the pad 522, so that the pad 522 is accommodated in the recess 526. The upper surface of the main plate 241 of the pad 522 and the upper surface of the pad piece 523 form the guide surface for guiding a sheet, together with the guide surface 521 of the base 520 when the pad 522 is accommodated in the recess 526.

Grooves 262 substantially complementary with the ribs 245 formed in the side plates 243 of the pad 522 are defined in surfaces of the side walls 261 of the base 520 which form side surfaces of the recess 526. The ribs 245 of the pad 522 engage with the grooves 262. As is clear from a comparison with the grooves 262 shown in FIG. 13, in the present embodiment, the grooves 262 do not extend toward a rotational axis of the feed roller 510, but extend in a more vertical direction rather than a direction toward the rotational axis.

Figure 24A:
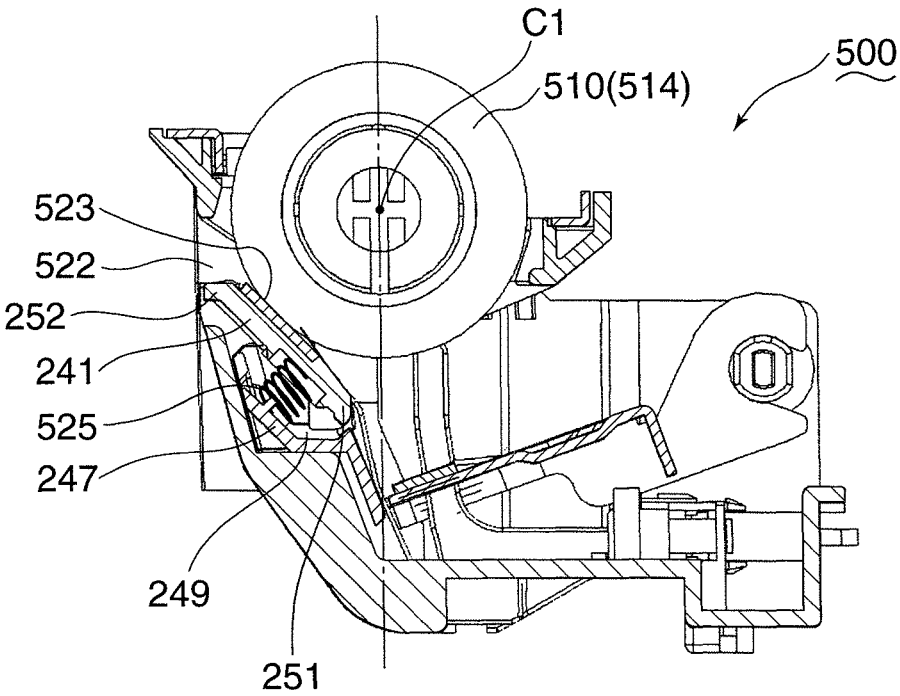
FIG. 24A is a schematic cross-sectional view showing a rotary movement of the pad shown in FIG. 21.
Figure 24B:
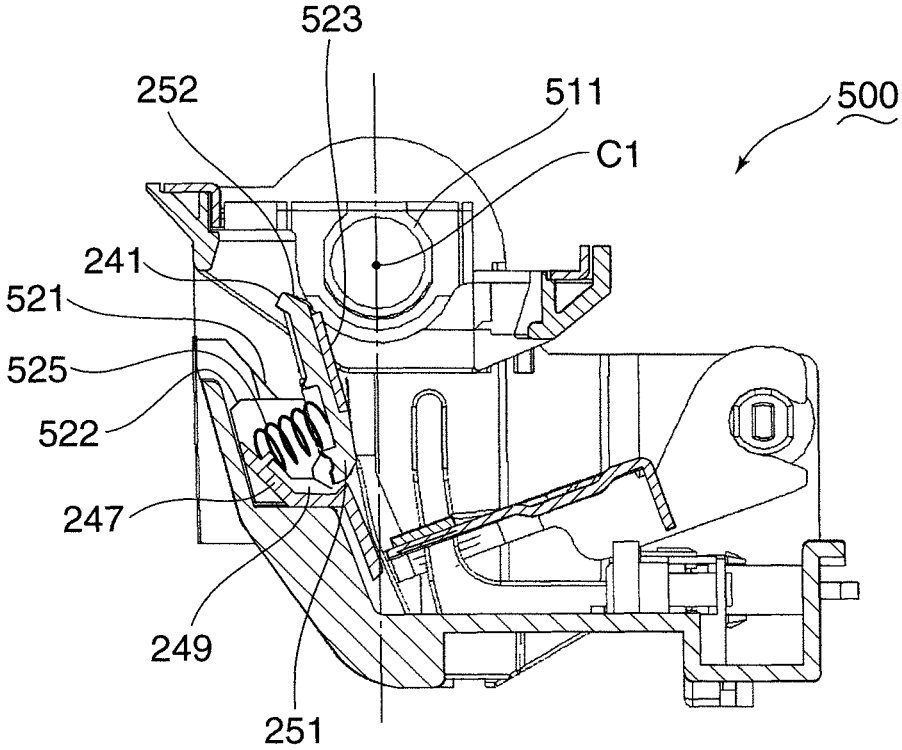
FIG. 24B is a schematic cross-sectional view showing a rotary movement of the pad shown in FIG. 21.

FIG. 24A is a schematic cross-sectional view of the feed assembly 500 on which the feed roller 510 is mounted. FIG. 24B is a schematic cross-sectional view of the feed assembly 500 from which the feed roller 510 is removed. Rotation of the main plate 241 is described here with reference to FIGS. 21 to 24B.

While the feed roller 510 is mounted on the drive shaft 511 (and the idle shaft 512), the coil springs 525 between the back-up plate 247 and the main plate 241 are compressed. Thus, the pad piece 523 supported on the main plate 241 is pressed against the conveyance tube 514 of the feed roller 510.

The feed roller 510 is suitably removed from the drive shaft 511 (and the idle shaft 512) by using the method described in the context of the first embodiment and/or the second embodiment. As a result, the coil springs 525 which have been compressed between the back-up plate 247 and the main plate 241 extend, so that the main plate 241 rotates about the rotating shafts 246. An upstream side of a rib 249 formed in the back-up plate 247 makes contact with a lower edge of the inner surface of the main plate 241 rotated to a prescribed position, so that the rotation of the main plate 241 is thereby halted (see FIG. 24B). Therefore, the rotation of the main plate 241 is halted before the main plate 241 passes a rotational axis C1 of the feed roller 510 (before passing a vertical line extending through the rotational axis C1 of the feed roller 510).

As described in FIG. 24B, the main plate 241 projects from the guide surface 521. Consequently, the user may pick the second edge 252 of the main plate 241 to remove the pad 522 from the recess 526 formed in the guide surface 521. In conjunction with the installation of a new pad 522, the feed assembly 500 returns again to the structure shown in FIG. 24B.

The main plate 241 of the new pad 522 similarly stands at a position which does not pass the rotational axis C1 of the feed roller 510. As described above, the second edge 252 of the main plate 241 bends toward a downstream side. Therefore, if the user subsequently installs the feed roller 510 on the drive shaft 511 (and the idle shaft 512), a circumferential surface of the conveyance tube 514 makes contact with the main plate 241 or the pad piece 523. Then, the main plate 241 rotates toward the back-up plate 247. The feed assembly 500 therefore returns to the structure shown in FIG. 24A.

In the series of embodiments described above, a pad 522 is exemplified as a frictional element. Alternatively, a roller configured to rotate in an opposite direction to a sheet conveyance (for example, a retarding roller with a torque limiter) may be used as the frictional element. Yet another alternative is to use another element or structure configured to prevents conveyance of overlapping sheets.

This application is based on Japanese Patent application serial Nos. 2009-269716 and 2010-048018 filed in Japan Patent Office on Nov. 27, 2009 and Mar. 4, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus configured to form an image on a sheet, comprising:

a feed assembly configured to feed the sheet; and an image forming unit configured to form the image on the sheet conveyed from the feed assembly; wherein the feed assembly includes:

a feed roller configured to convey a sheet;

a support element configured to detachably and rotatably support the feed roller;

a base including a guide surface configured to guide the sheet;

a frictional element including a frictional piece that presses the sheet against the feed roller to generate a frictional force on the sheet guided by the guide surface; and a coil spring provided between the frictional piece and the base; and wherein a recess is defined in the guide surface to accommodate the friction element;

the frictional element projected from the guide surface when the feed roller is detached from the support element becomes detachable from the base;

a groove is formed in a surface of the base that defines a side surface of the recess and has a longitudinal extension direction extending toward a rotational axis of the feed roller; and the frictional element includes:

a rib complementary with the groove, the rib is engaged with the groove to guide the frictional element toward the rotational axis of the feed roller, a holder including a main plate that supports the frictional piece, a side plate that rotatably supports the main plate, and a back-up plate that supports the coil spring including a first spring end connected to the main plate and a second spring end connected to the back-up plate;

the coil spring causes the main plate to rotate with respect to the side plate when the feed roller is detached from the support element.

2. The image forming apparatus according to claim 1, wherein:

the back-up plate includes a projection projecting toward the main plate; and the projection halts rotation of the main plate when the feed roller is detached from the support element.

3. The image forming apparatus according to claim 2, wherein:

the projection halts the rotation of the main plate before the main plate rotates beyond a rotational axis of the feed roller.

4. The image forming apparatus according to claim 3, wherein:

the main plate includes a first edge extending along a rotational axis of the main plate and a second edge opposite the first edge; and the second edge curves toward a downstream side in terms of the conveyance direction of the sheet.

5. The image forming apparatus according to claim 1, wherein the side surface of the recess is substantially normal to the rotational axis of the feed roller.

6. The image forming apparatus according to claim 1, wherein the side surface of the recess is a first side surface and the groove is a first groove, the recess further having a second side surface opposed to the first side surface and a second groove being formed in the second side surface, the first and second grooves being substantially parallel and having extension directions extending toward the rotational axis of the feed roller.

7. The image forming apparatus according to claim 6, wherein the frictional element has first and second ribs engageable respectively with the first and second grooves.

8. A feed assembly configured to feed a sheet, comprising:

a feed roller configured to convey the sheet;

a support element configured to rotatably and detachably support the feed roller;

a base including a movable portion and an immovable portion, a guide surface formed on the base and configured to guide the sheet, the guide surface including a movable surface on a first end of the movable portion of the base and an immovable surface disposed on the immovable portion of the base, the immovable surface being adjacent the movable surface, a recess being defined in the movable surface and a groove formed in a portion of the base that defines a side surface of the recess, the groove extending toward the feed roller, the movable portion including a second end opposite the first end and a rotating portion between the first and second ends, the rotating portion being connected rotatably to the immovable portion;

a frictional element accommodated at the recess and including a rib complementary to the groove defined in the recess, the frictional element being configured to generate a frictional force on the sheet guided by the guide surface, the frictional element projected from the guide surface when the feed roller is detached from the support element so that the frictional element becomes detachable from the base;

an elastic member provided between the frictional element and the base;

a lift plate configured to press the sheet against the feed roller, the lift plate including a base end rotatably mounted on the immovable portion, a pressing portion configured to make contact with the second end of the movable portion so that when the lift plate is rotated in a direction away from the feed roller to press against the second end, the movable portion rotates about the rotating portion and the movable surface projects from the immovable surface.

* * * * *